US007591567B2

(12) United States Patent
Wilcox et al.

(10) Patent No.: US 7,591,567 B2
(45) Date of Patent: Sep. 22, 2009

(54) LUMINAIRE WITH A COMPOUND PARABOLIC REFLECTOR

(75) Inventors: Kurt S. Wilcox, Libertyville, IL (US); Eric J. Haugaard, Kenosha, WI (US)

(73) Assignee: Ruud Lighting, Inc., Racine, WI (US)

( * ) Notice: Subject to any disclaimer, the term of this patent is extended or adjusted under 35 U.S.C. 154(b) by 0 days.

(21) Appl. No.: 11/752,857

(22) Filed: May 23, 2007

(65) Prior Publication Data

US 2008/0291680 A1 Nov. 27, 2008

(51) Int. Cl.
*F21V 7/00* (2006.01)

(52) U.S. Cl. ..... 362/297; 362/304; 362/346

(58) Field of Classification Search ..... 362/225, 362/238, 240, 241, 296–298, 304, 307, 309, 362/329, 339–341, 346–348, 350, 410, 414, 362/418, 427; 359/868, 869
See application file for complete search history.

(56) References Cited

U.S. PATENT DOCUMENTS 4,218,727 A 8/1980 Shemitz et al.
4,261,030 A 4/1981 Hernandez
4,336,577 A * 6/1982 Hanson ..... 362/267
4,344,120 A * 8/1982 Bradley et al. ..... 362/349
4,451,875 A 5/1984 Odle et al.
4,547,841 A * 10/1985 Quiogue ..... 362/269
4,665,471 A * 5/1987 Tarnay ..... 362/267
4,689,729 A 8/1987 Ruud et al.
4,704,661 A * 11/1987 Kosmatka ..... 362/518
4,709,312 A 11/1987 Heinisch et al.
4,856,103 A 8/1989 Compton
4,992,911 A * 2/1991 Ressia ..... 362/518
5,274,534 A 12/1993 Armstrong
5,515,255 A 5/1996 Nielson et al.
5,645,344 A 7/1997 Wijbenga
5,971,571 A 10/1999 Rose
6,338,564 B1 1/2002 Jordan et al.
6,382,803 B1 5/2002 Arumugasaamy (Continued)

OTHER PUBLICATIONS

Excerpts from Ruud Lighting, Inc. 2006 Catalog. Ruud Lighting, Inc., Racine, WI. Date: 2006 (8 pages).

(Continued)

*Primary Examiner*—Hargobind S Sawhney
(74) *Attorney, Agent, or Firm*—Jansson Shupe & Munger Ltd.

(57) ABSTRACT

Luminaires for illuminating a target zone having target zone subregions in front of and to the sides of the luminaire. The luminaire includes a housing, a lamp holder in the housing positioned to support an electric lamp in a generally vertical orientation, and a compound parabolic reflector in the housing partially surrounding a lamp light-emitting segment location having plural regions. Preferred forms of the compound parabolic reflector include segmented center and side portions. The preferred segmented center portion has a first plurality of two-dimensional parabolic segments each of which has a focal point in a different one of the plural light-emitting segment location regions. The preferred segmented side portions are each provided with a second plurality of two-dimensional parabolic segments having focal points along the light-emitting segment location. The parabolic segments are effective to direct a preponderance of light toward the plural target zone subregions.

19 Claims, 24 Drawing Sheets

U.S. PATENT DOCUMENTS

| | | | | |
|---|---|---|---|---|
| 6,464,378 | B1 * | 10/2002 | Reed et al. | 362/297 |
| 6,502,963 | B1 | 1/2003 | King | |
| 6,568,835 | B2 | 5/2003 | Wijbenga et al. | |
| 7,029,148 | B2 | 4/2006 | White et al. | |
| D565,225 | S | 3/2008 | Haugaard et al. | |
| D565,227 | S | 3/2008 | Haugaard et al. | |
| D565,229 | S | 3/2008 | Haugaard et al. | |
| 2006/0044805 | A1 | 3/2006 | Wijbenga et al. | |

OTHER PUBLICATIONS

Excerpts from Ruud Lighting, Inc. 2007 Catalog. Ruud Lighting, Inc., Racine, WI. Date: 2007 (6 pages).
Specification sheet for the AVV30-25 series. Ruud Lighting, Inc., Racine, WI. Date: 2008 (2 pages).
Specification sheet for the AVV40-25 series. Ruud Lighting, Inc., Racine, WI. Date: 2008 (2 pages).
PCT/US07/12256, May 23, 2007, Wilcox et al.

* cited by examiner

LUMINAIRE WITH A COMPOUND PARABOLIC REFLECTOR

FIELD

The field is related generally to luminaries and, more particularly, to luminaires provided to brightly illuminate a strip-like area in front of and to the sides of the luminaire.

BACKGROUND

Lighting devices with incandescent and arc discharge lamps are routinely used to illuminate the exterior areas of commercial businesses for purposes of enhancing the appearance of the business at night and for promoting interest in the goods and services of the business by actual and potential customers. Restaurants, shopping malls, and automobile dealerships represent just a few of the business types for which exterior luminaires play an important role in marketing and facilitating product sales.

In the example of automobile dealerships, exterior area lighting is frequently used to illuminate the exterior surface parking lots which surround the typical automobile dealership. The lighting fixtures are typically pole-mounted so as to distribute light across the exterior surface parking lot. The purpose of the exterior area lighting is to illuminate the rows of automobiles parked side-by-side outside the dealership so that they can be viewed at night by potential customers driving past the dealership and by customers who may walk onto the dealership property. Since automobiles available for sale on a dealership exterior surface parking lot tend to be organized in rows, it is advantageous to provide exterior area luminaires which project uniform bright light in a generally rectangular pattern to the front and sides of the luminaires, concentrated on the row of automobiles.

It is particularly advantageous for automobile dealerships to brightly and uniformly illuminate the outermost row of automobiles which is the row which can be most easily seen by passing customers. This outermost row of automobiles is often referred to as the "front line" of automobiles. Bright illumination of these front line automobiles is useful to attract customers by enhancing the gloss, shine and generally attractive appearance of the automobiles available for sale.

While many exterior area lighting products are available, such products are not optimally effective in brightly illuminating a generally rectangular area in front of and to the sides of the luminaire. For example, luminaires which include a vertically oriented lamp tend to be effective in producing a more circular lighting effect because of the upright orientation of the lamp arc or filament but tend to be less than satisfactory in generating a rectangular lighting effect for the same reason. A solution to this problem is to provide a luminaire with a horizontally mounted lamp. The horizontal orientation of the lamp arc or filament is more conducive to production of a rectangular lighting effect. However, horizontally mounted lamps tend to be relatively energy inefficient compared with vertically mounted lamps because more energy is required to operate the lamp to overcome the effect of gravity on the lamp arc.

While it is important for businesses such as automobile dealerships to use exterior area lighting for purposes of aesthetics and marketing, it is also important to employ exterior area lighting which is energy efficient and which provides the needed illumination at the least possible cost to the business. One way to achieve these efficiencies is to provide exterior lighting which is optimized for efficient area light distribution, thereby providing an opportunity to space the luminaires far apart so as to minimize the number of luminaires required to illuminate a given area. Another way to achieve these efficiencies is to provide exterior area lighting which optimally illuminates the products and things to be illuminated and nothing else, thereby converting consumed energy to useful light. Yet another strategy is to utilize luminaires with generally vertically oriented lamps so as to minimize energy consumption compared to a horizontally mounted lamp.

Many governmental entities are enacting rules and regulations requiring use of more energy efficient luminaires. For example, some governmental entities have enacted rules limiting or banning the use of the relatively less efficient luminaires with horizontally oriented lamps. And, governmental entities are adopting building codes and other rules imposing limits on the amount of electrical energy that can be consumed by a commercial business which utilizes exterior area illumination. Use of more efficient luminaires, therefore, is being driven by a growing body of governmental regulations.

An issue related to efficient exterior area illumination is the need to avoid what is called "light trespass." Light trespass refers to spillage of light from one exterior location to an adjacent exterior location. In effect, light trespass represents wasted light. Not only is this inefficient, but such light trespass can be a violation of governmental regulations.

As can be appreciated, automobile dealerships with exterior surface parking lots and numerous exterior luminaires must be mindful of avoiding unwanted spillage of light onto the property of adjacent businesses, residences, and roadways. Illumination of front line automobiles at the dealership should be targeted and effective to promote the sale of product while minimizing any unwanted impact on the enjoyment of adjacent property by others or of operation of motor vehicles passing by the automobile dealership on an adjacent roadway.

There exists a need exists for an improved luminaire, particularly a luminaire which provides desired lighting distribution and efficiency.

SUMMARY

A luminaire for illuminating a target zone area to the front of and to the sides of the luminaire. The luminaire includes a housing, a lamp holder in the housing positioned to support an electric lamp in a generally vertical orientation, and a compound parabolic reflector in the housing. The housing includes walls defining a bottom opening through which light exits the housing.

The compound parabolic reflector partially surrounds a lamp with a vertical light source with plural source-sectors which correspond to the three-dimensional space occupied by the light emitting segment of a lamp when mounted in the lamp holder. Preferred embodiments of the compound parabolic reflector include a segmented center portion and segmented side portions. The preferred segmented center portion has first and second side edges and a first plurality of center segments. In the preferred embodiment, each of the first plurality of center segments is parabolic in cross-section, such parabolic cross-sections have focal points in different plural source-sectors, such that each segment directs a preponderance of its reflected light toward a particular target zone subregion in front of the luminaire.

The preferred segmented side portions are each joined to the center portion along a respective one of the side edges. The preferred side portions each have a second plurality of side segments each of which is parabolic in cross-section, such parabolic cross-sections have focal points along the source-sectors such that each segment directs a preponderance of its reflected light toward a particular target zone subregion to a respective side of the luminaire. Generally uniform illumination of the target zone is provided by the first and second plurality of parabolic segments. Various other aspects and preferred features of the luminaires are described herein.

BRIEF DESCRIPTION OF THE DRAWINGS

Exemplary luminaires may be understood by reference to the following description taken in conjunction with the accompanying drawings, in which like reference numerals identify like elements throughout the different views. For convenience and brevity, like reference numbers are used for like part amongst the alternative embodiments. The drawings are not necessarily to scale, emphasis instead being placed upon illustrating the principles of the invention. In the accompanying drawings.

Figure 1:
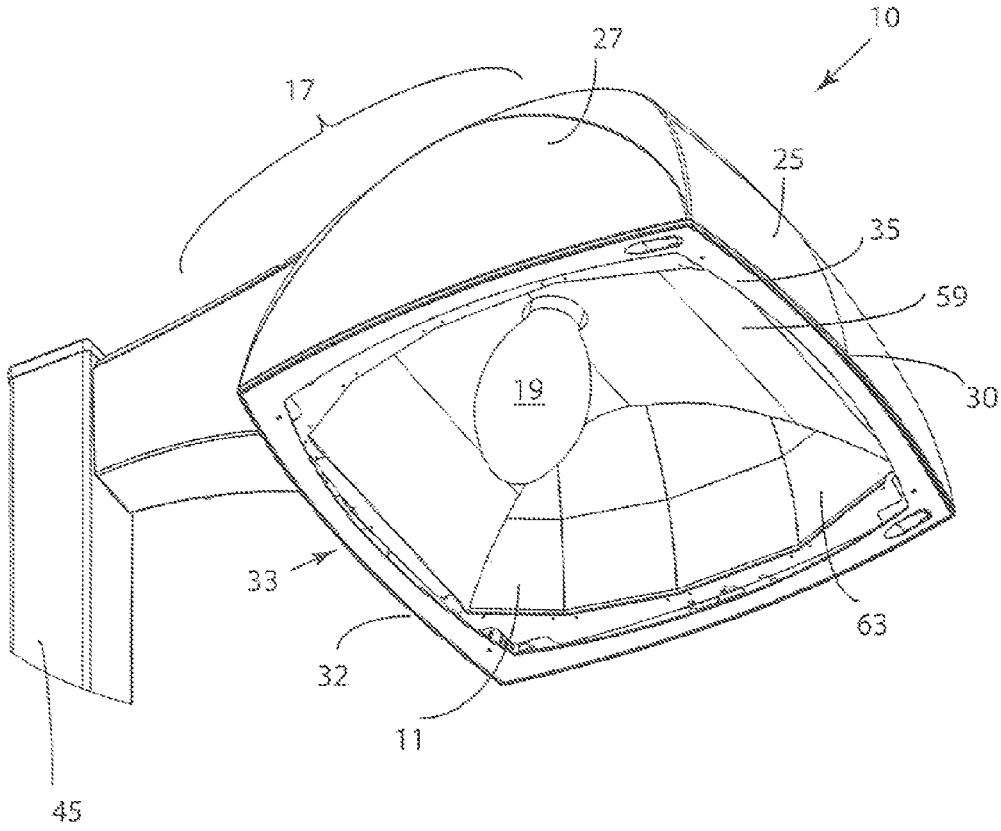
FIG. 1 is a perspective view of an exemplary luminaire including a compound parabolic reflector shown mounted on a pole.
Figure 2:
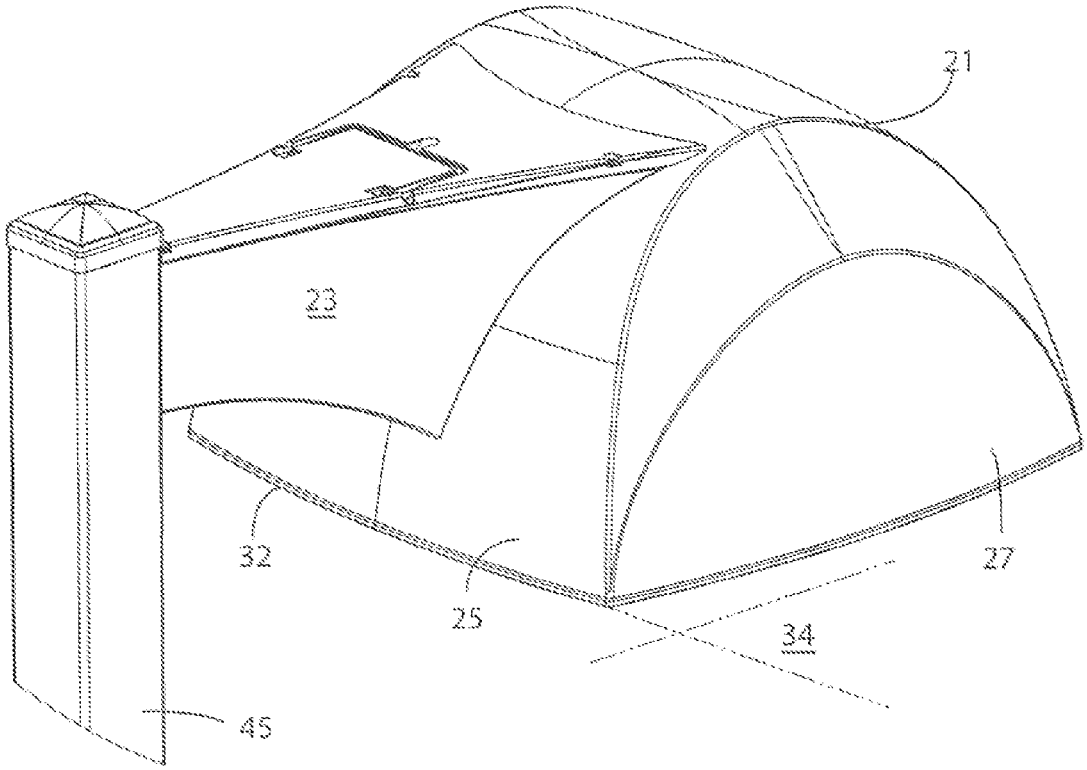
FIG. 2 is a further perspective view of the luminaire of FIG. 1.
Figure 3:
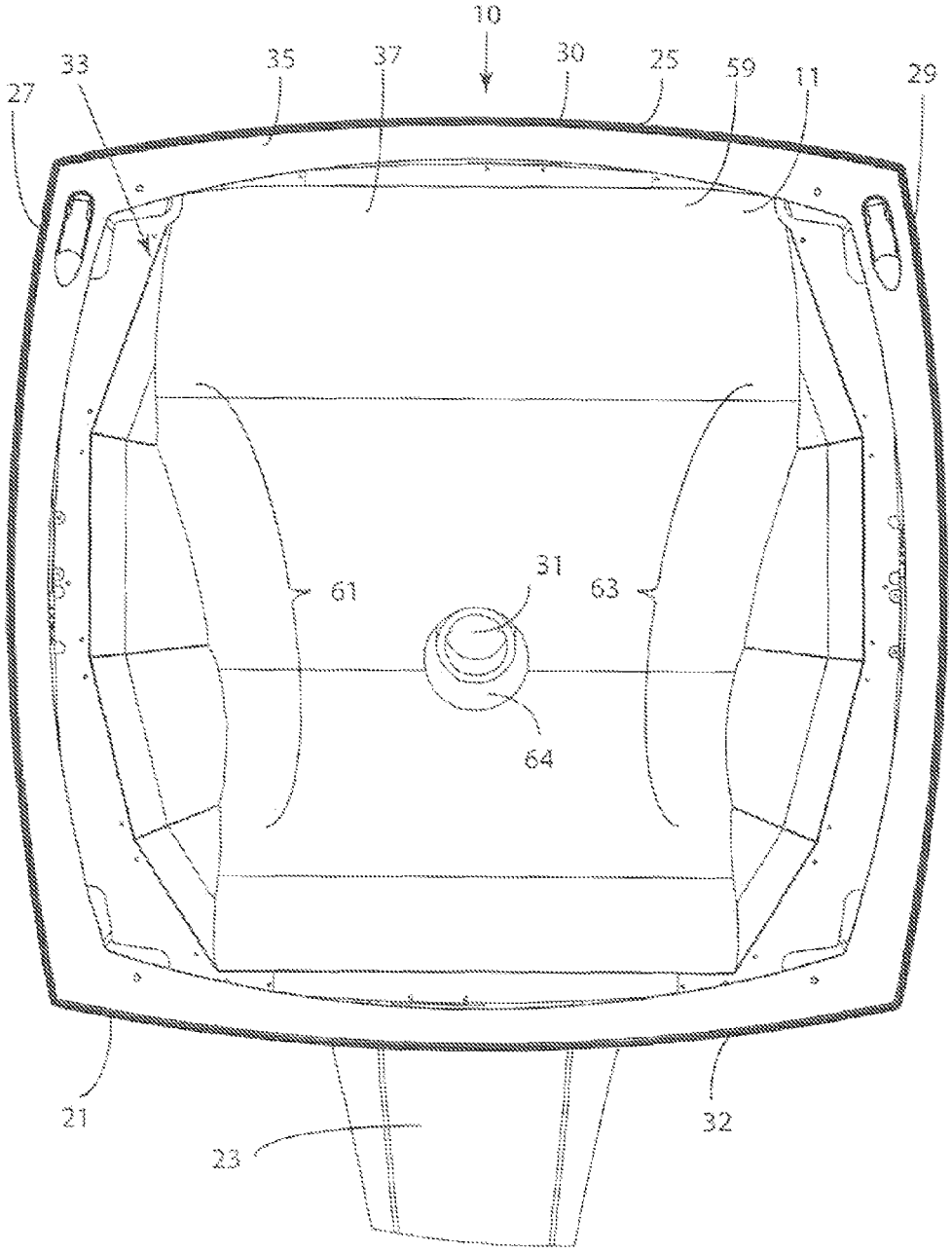
FIG. 3 is a bottom-side view of the luminaire of FIG. 1 but with the lamp removed, thereby showing a lamp holder.

While the apparatus is susceptible to various modifications and alternative forms, specific embodiments thereof have been shown by way of example in the drawings and are herein described in detail. It should be understood, however, that the description herein of specific embodiments and methods is not intended to limit the invention to the particular forms disclosed, but on the contrary, the intention is to cover all modifications, equivalents, and alternatives falling within the spirit and scope of the invention as defined by the appended claims.

DETAILED DESCRIPTION

FIGS. 1-3 and 6-7 show embodiments of a luminaire 10 with a compound parabolic reflector 11. A "luminaire" as used herein means or refers to a lighting device consisting of one or more electric lamps and with all of the necessary parts and wiring. Reflector 11 is referred to herein as "compound" and "parabolic" because reflector 11 is segmented, with each of the plural segments representing part of a parabola. Reflector 11 takes advantage of the plural segments and the light-directing properties of the partial parabolic portions to produce a lighting effect which brightly, uniformly, and efficiently illuminates a target zone 13 (FIGS. 4, 5, 8) of a generally rectangular area to the sides and front of the luminaire 10. For convenience and brevity, the visible spectra electromagnetic radiation discharged from luminaire 10 will be referred to herein as "light" or "light energy."

Luminaire 10 has utility in many different commercial exterior area lighting applications where intense, uniform illumination of a strip of surface area (i.e., target zone 13) is desired. Such applications would include, for example, illumination of the "front line" of automobiles parked outside an automobile dealership or illumination of the drive-up lane or lanes of a fast-food restaurant.

Luminaire 10 is highly efficient because of the targeted lighting effect provided by the partial parabolic segments of reflector 11. Luminaire 10 is capable of brightly illuminating large surface areas, thereby providing lighting planners with the opportunity to space the luminaires 10 further apart while providing a consistent high level of lighting. This, in turn, permits usage of relatively fewer luminaires 10 for a given area, thereby reducing energy consumption and the long-term costs associated with operating luminaire 10. The targeted lighting provided by the partial parabolic segments further increases efficiency because light is directed where needed with little light trespass behind and away from luminaire 10. Light trespass behind luminaire 10 can be further minimized by use of a light shield 15 as described herein. And, these results are obtained without the need for a relatively less efficient horizontally mounted lamp. These features provide the lighting planner and end user with the opportunity for excellent exterior lighting while controlling costs and providing compliance with government energy and land usage regulations.

Referring now to FIGS. 1-3 and 5-6, exemplary luminaire 10 includes a housing 17, a generally vertically oriented lamp 19, and a compound parabolic reflector 11. Housing 17 may include an optic housing portion 21 and a side arm housing portion 23. If provided as a separate housing portion, optic housing portion 21 may include center 25, and a side wall 27, 29 portions which enclose reflector 11 and a lamp holder 31 in which lamp 19 is mounted. Housing portion 21 includes front 30 and rear 32 sides. While three wall portions 25-29 are shown, any number of walls may be selected in the design of housing 17. Housing walls 25-29 define a generally horizontal bottom opening 33 which lies in a generally horizontal plane 34.

Lamp holder 31 is positioned in optic housing portion 21 to support lamp 19 mounted therein in a generally vertical orientation. A generally vertical orientation means or refers to an orientation which is ± about 15° to vertical. Luminaire 10 may be sold with or without a lamp 19 mounted in lamp holder 31 since the user can install a lamp 19 at the site at which luminaire 10 is located for use.

A lens frame 35 supporting a lens 37 is provided to cover opening 33. In the embodiment, lamp holder 31 supports lamp 19 so that lamp is above plane 34 and lens 37 when frame 35 is closed. Because lamp 19 is above plane 34, housing walls 25-29 provide full cut off of stray light so that useful light is directed at the target zone 13. Lens frame 35 is relatively movable between luminaire-closed and luminaire-open positions for lamp-changing purposes. Closure of lens frame 35 creates a sealed, weather-tight enclosure about lamp 19. Lens 37 is preferably of high-impact tempered glass but can be made of other light-transmissive materials. Light energy is discharged through lens 37 toward target zone 13 as described in more detail below. The preferred lens 37 shown in planar.

Figure 6:
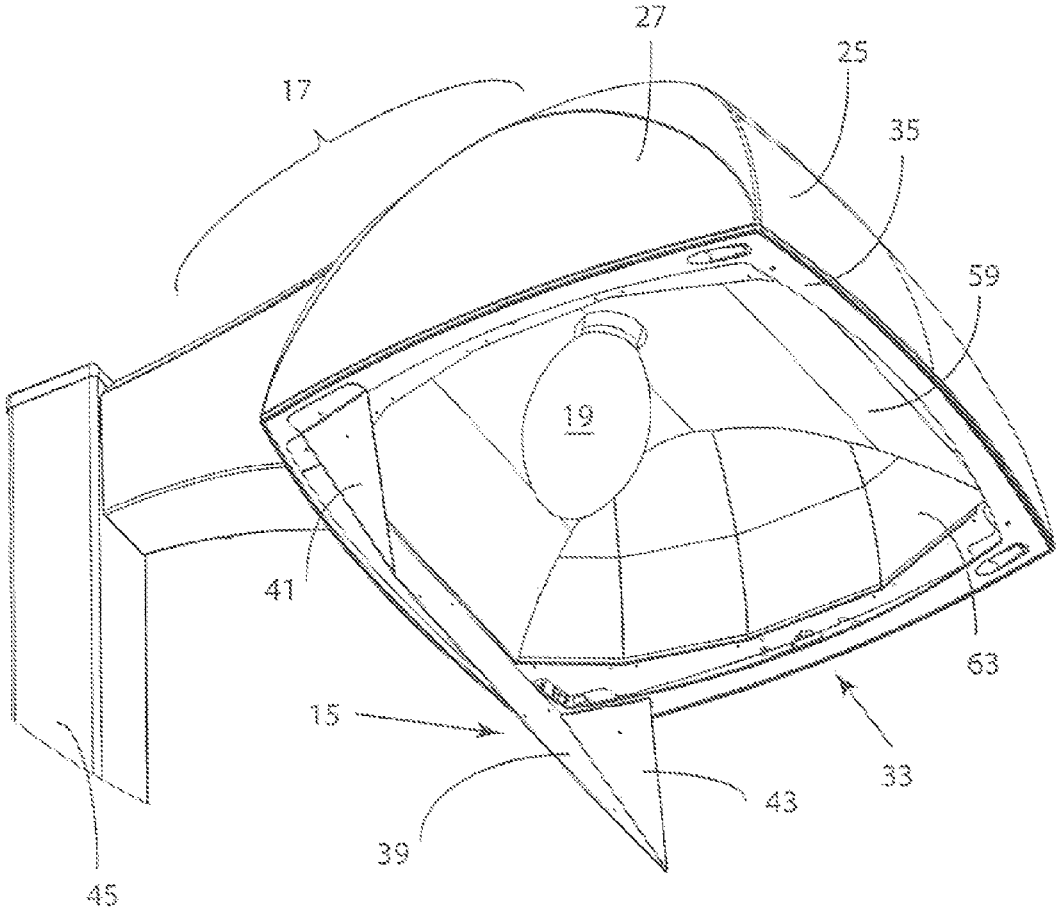
FIG. 6 is a further perspective view of the luminaire of FIG. 1 but including an exemplary light shield.
Figure 7:
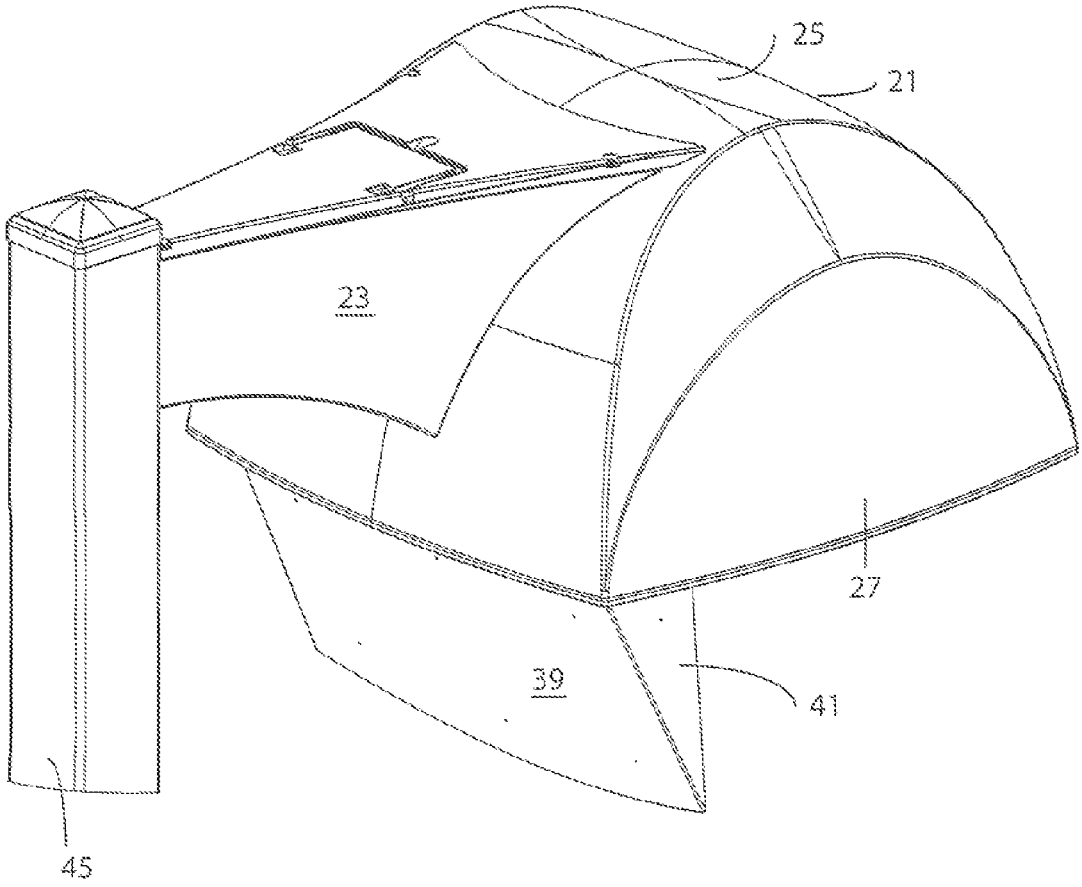
FIG. 7 is a perspective view of the luminaire of FIG. 6.

Optional light shield 15 may be mounted to lens frame 35 adjacent housing rear side 32 to extend below plane 34 as shown in FIGS. 6-7 to block emission of light from lamp 19 rearward from luminaire 10. In the embodiment, light shield 15 includes continuous rear 39 and side 41, 43 panels which extend downwardly from a rear portion of lens frame 35. The sizing, length and width of panels 39-43 is a design choice based on the amount of light which is desired to be blocked.

Housing side arm portion 23 encloses the electrical/mechanical components (not shown) necessary to provide proper voltage and current for starting and operation of lamp 19. These components typically include a power supply, ballast, ignitor, and capacitor. Other components may be utilized depending on the application. Housing side arm portion 23 is preferably designed for attachment to a pole 45 or a surface-mounted support (not shown) by bolts or other mechanical fasteners.

Lamp 19 may be of any suitable lamp type. Examples are incandescent and arc-discharge lamp types. An example of a lamp type suitable for use with luminaire 10 is a high intensity discharge (HID) lamp. Lamp 19 is preferably in the range of 400 to 1500 Watts. Such HID lamps include metal halide, high pressure sodium, and mercury vapor lamps. Lamp 19 includes a generally axial light-emitting segment 47 along axis 48 which emits the light energy (see FIG. 16). For metal-halide-type lamps, the light-emitting segment 47 is an envelope 49 (FIG. 16) within lamp 19 which encloses electrodes (not shown) and the metal halide salts. Light energy is emitted from envelope 49 by ignition of a plasma arc between the electrodes which are at opposite ends of envelope 49. The electrodes define axis 48 within envelope 49 coaxial with light-emitting segment 47.

Light-emitting segment 47 is considered to have upper and lower regions 51, 55 and a central region 53 therebetween for the purpose described below. The "light-emitting segment location" also referred to as a "vertical light source with plural source-sectors," means or refers to the three-dimensional space occupied by the light-emitting segment 47 (see FIGS. 16 and 17). Compound parabolic reflector 11 partially surrounds this light-emitting segment location/plural source-sector to optimize the lighting effect provided by luminaire 19 as described herein.

Referring to FIGS. 3, and 9-14, compound parabolic reflector 11 includes a segmented center portion 59, a first segmented side portion 61, and a second segmented side portion 63. Segmented portions 59, 61, 63 partially surround lamp 19 and light-emitting segment 47. In the example, segmented side portions 61, 63 are substantially mirror images of one another. Collectively, portions 59, 61, and 63 partially surround the light-emitting segment 47 of a lamp 19 mounted in lamp holder 31 (extending through opening 64) to reflect or redirect light from light-emitting segment 47 of an energized lamp 19 through lens 37 and out of luminaire 10.

Segmented center portion 59 is defined by first and second side edges 65, 67 and front 69 and rear 71 ends. Center portion 59 is connected to first side portion 61 along side edge 65 and to second side portion 63 along side edge 67. In the embodiment, center 59 and side portions 61, 63 may be joined together along respective edges 65, 67 by means of tabs (examples of which are indicated by ref. no. 72) along an upper edge of each side panel 61, 63 inserted into a corresponding slotted opening (examples of which are indicated by ref. no. 74) along each side of center portion 59 as illustrated in FIGS. 9-14.

In the preferred example shown, center portion 59 includes a first plurality of two-dimensional parabolic segments 73, 75, 77. Each of the preferred three segments 73, 75, 77 front-to-rear is a separate two-dimensional parabola. Each of the three segments 73, 75, 77 is a segment which is a set of points formed by parallel movement of a line along a parabolic path. Such segments are also referred to herein as partial parabolas or parts of a parabola. As will be described in more detail below, the two-dimensional parabolic section of each segment 73-77 has a focal point 79, 81, 83 in a different one of the plural light-emitting segments 51, or 53, or 55. This arrangement permits each parabolic segment 73-77 to direct a preponderance of light toward a different target zone subregion 133, 135, 137 in front of and to the sides of luminaire 10. (See FIGS. 4, 16 and 17.)

Each segmented side portion 61, 63 of the preferred example has four sections front-to-rear including a first, or front, section 85, 93, a second section 87, 95, a third section 89, 97 and a fourth, or rear, section 91, 99. In the example, side portion 61, includes sections 85-91 each of which is comprised of two segments 101, 103, 105, 107, 109, 111, 113, 115. Segments 101-113 represent a second plurality of two-dimensional parabolic segments. Because side portion 63 is preferably a mirror image of side portion 61, side portion 63, also includes sections 93-99, each of which is comprised of two segments 117, 119, 121, 123, 125, 127, 131, 133. Segments 117-133 also represent a second plurality of two-dimensional parabolic segments. Each of such segments 101-133 is a part of its own two-dimensional parabola, and each segment 101-133 is shaped and oriented such that it forms part of its two-dimensional parabola in a generally vertical plane and another two-dimensional parabola in a generally horizontal plane, thereby enabling these portions of reflector 11 to direct light both downward and to the side to target area subregions 139-169.

In the example, each segment 101-133 of each section 85-99 is arranged above or below the other providing a total of sixteen segments 101-133 along the side panels. Therefore, the exemplary compound parabolic reflector 11 includes a total of nineteen partial parabolic segments 73-77 and 101-131. The two-dimensional parabolic section of each segment 101-131 has a focal point 138 in the light-emitting segment location corresponding to the space occupied by light-emitting segment 47 and directs a preponderance of light toward subregions 139-169 of the target zone 13 to a respective side of luminaire 10.

Figure 4:
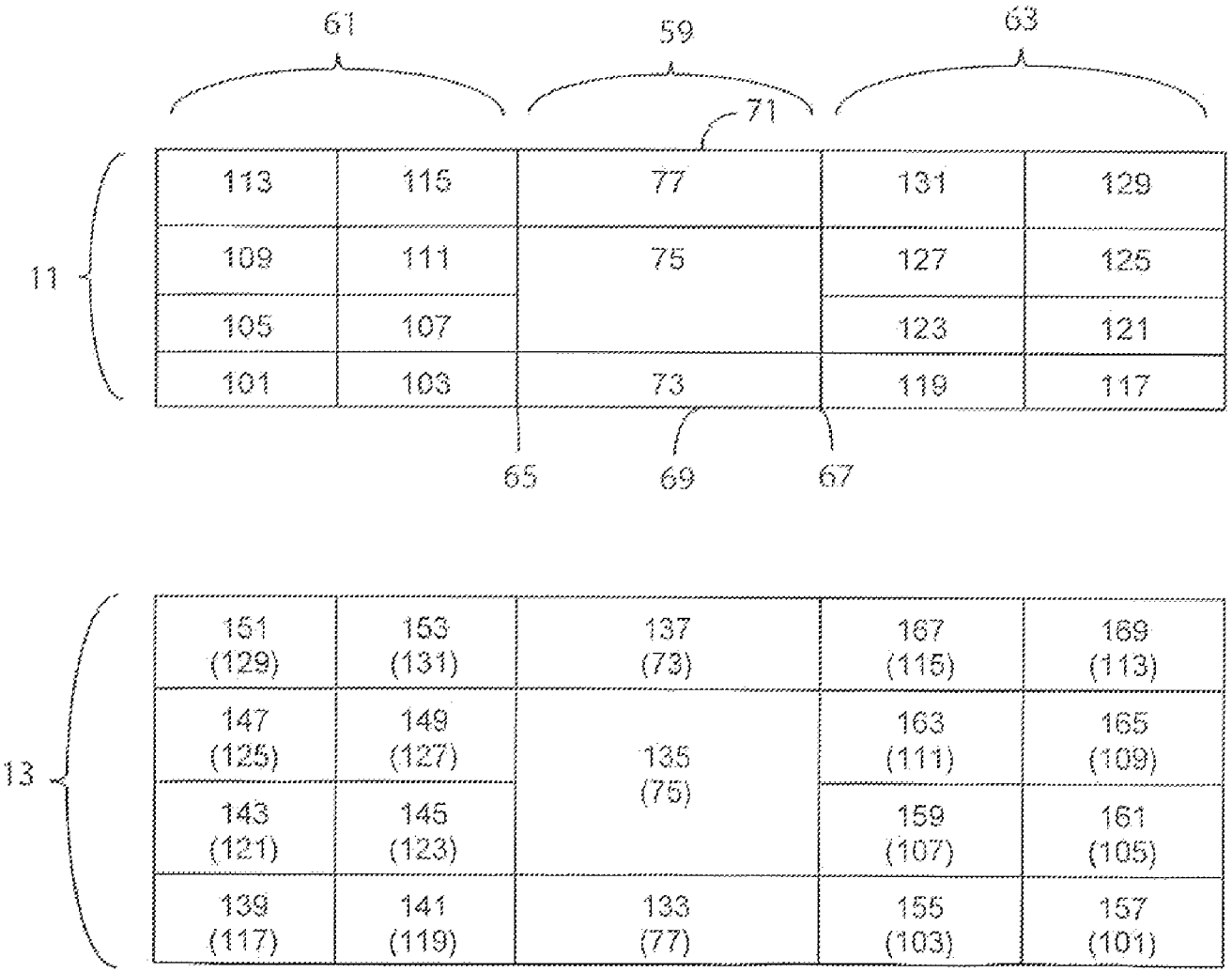
FIG. 4 is a schematic illustration of exemplary target zones illuminated by the luminaire of FIG. 1.
Figure 5:
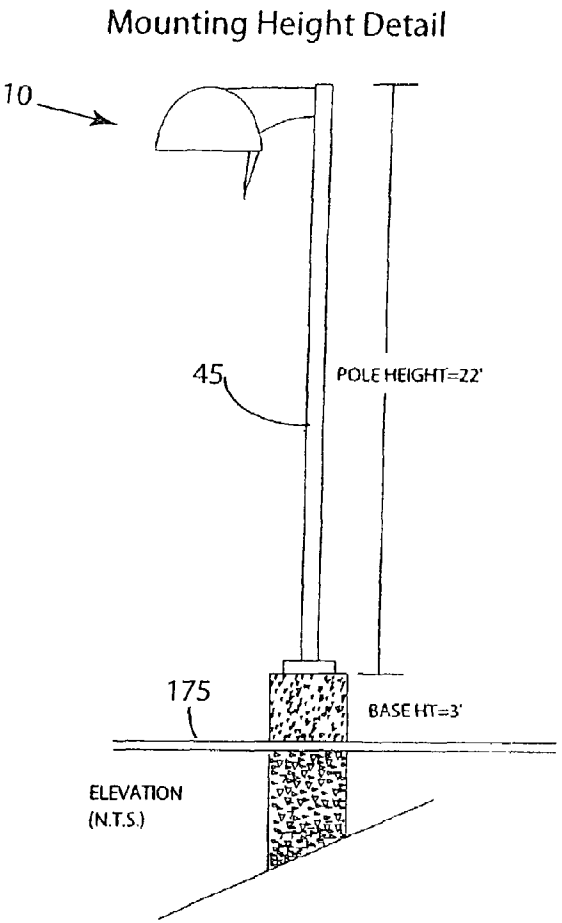
FIG. 5 is a computer-generated isolux map showing a simulation of light produced by the luminaire of FIG. 1 and an inset of such luminaire.
Figure 5:
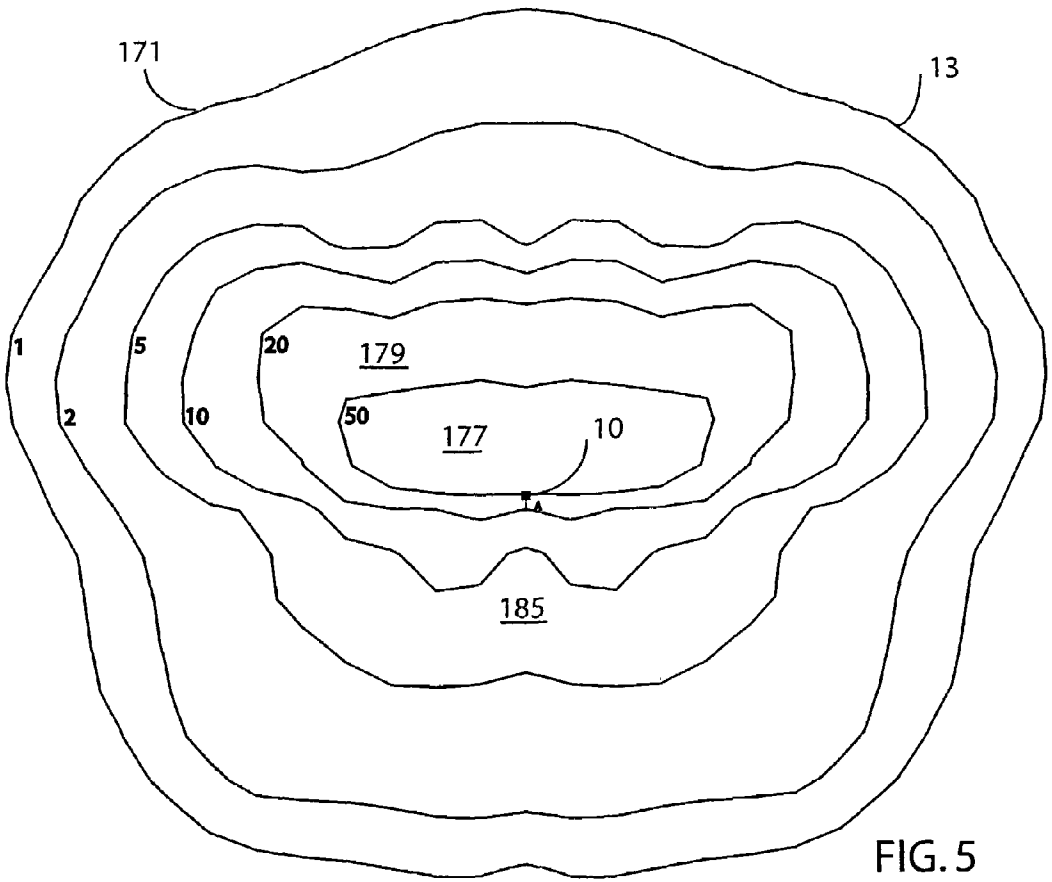
Figure 8:
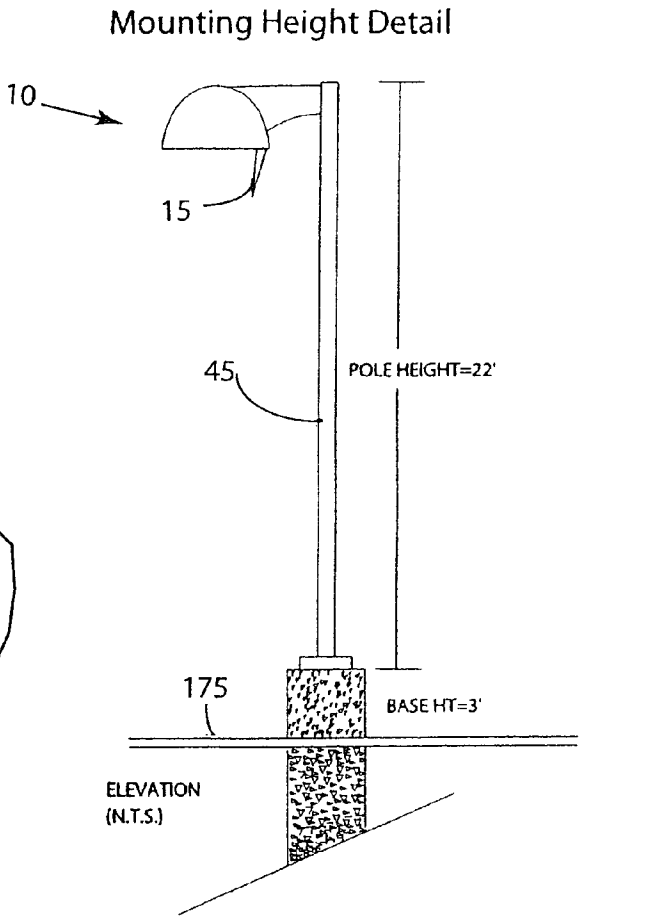
FIG. 8 is a computer-generated isolux map showing a simulation of light produced by the luminaire of FIG. 6 and an inset of such luminaire.
Figure 8:
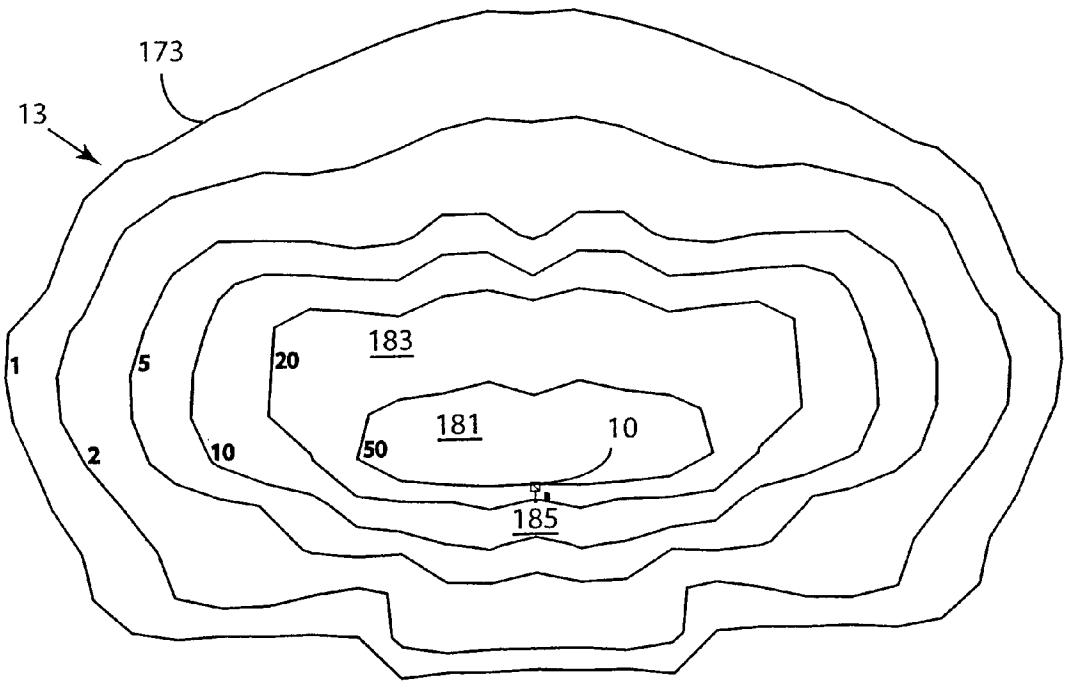
Figure 9:
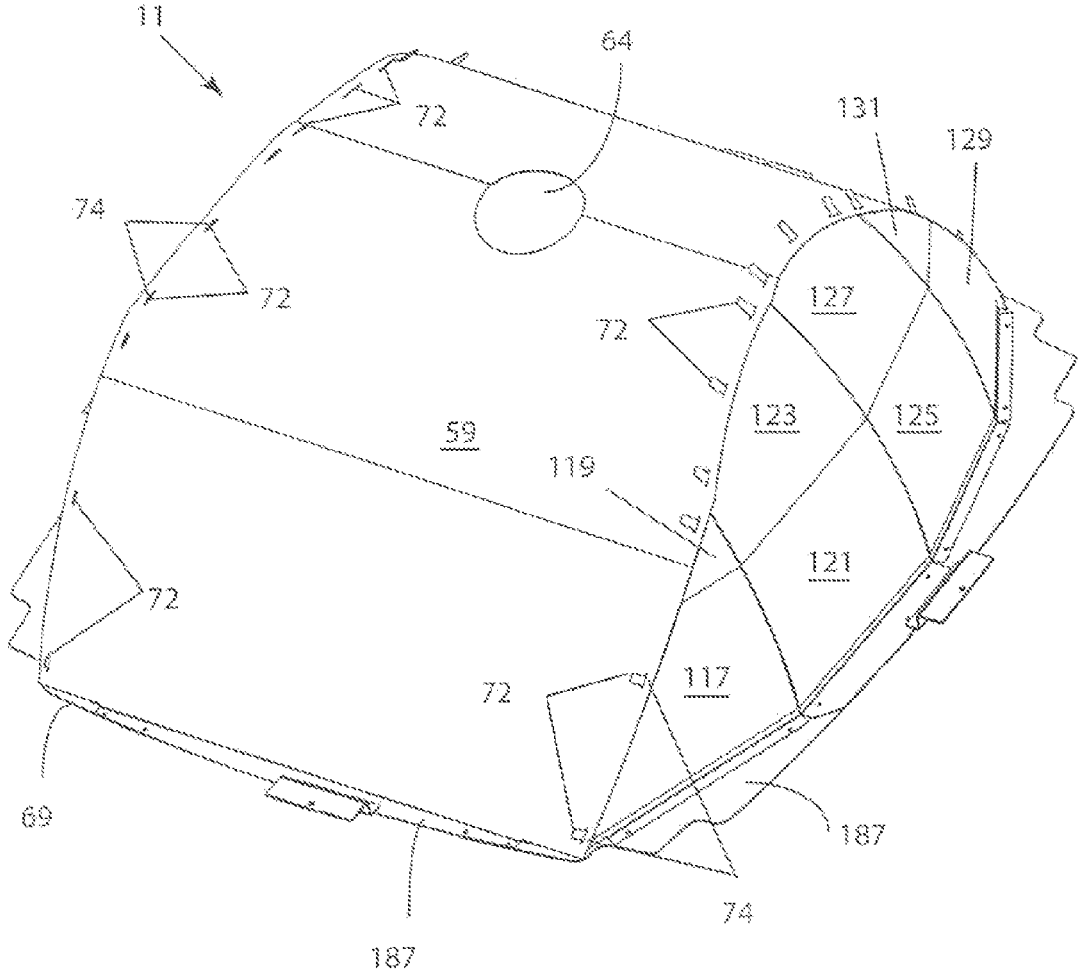
FIG. 9 is a perspective view of an exemplary compound parabolic reflector for use in the luminaire of FIGS. 1 and 6.
Figure 10:
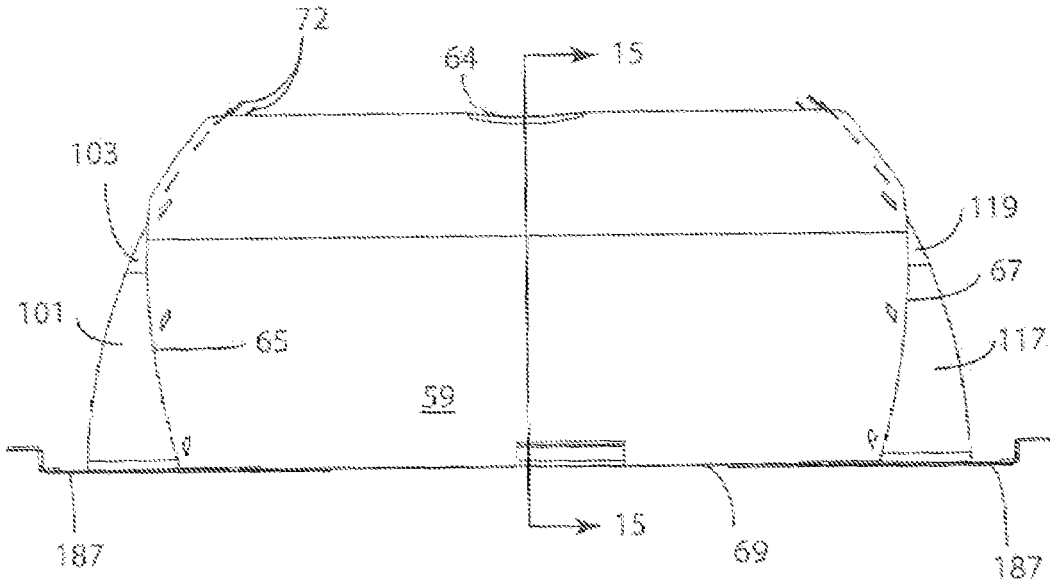
FIG. 10 is a front side elevation view of the reflector of FIG. 9.
Figure 11:
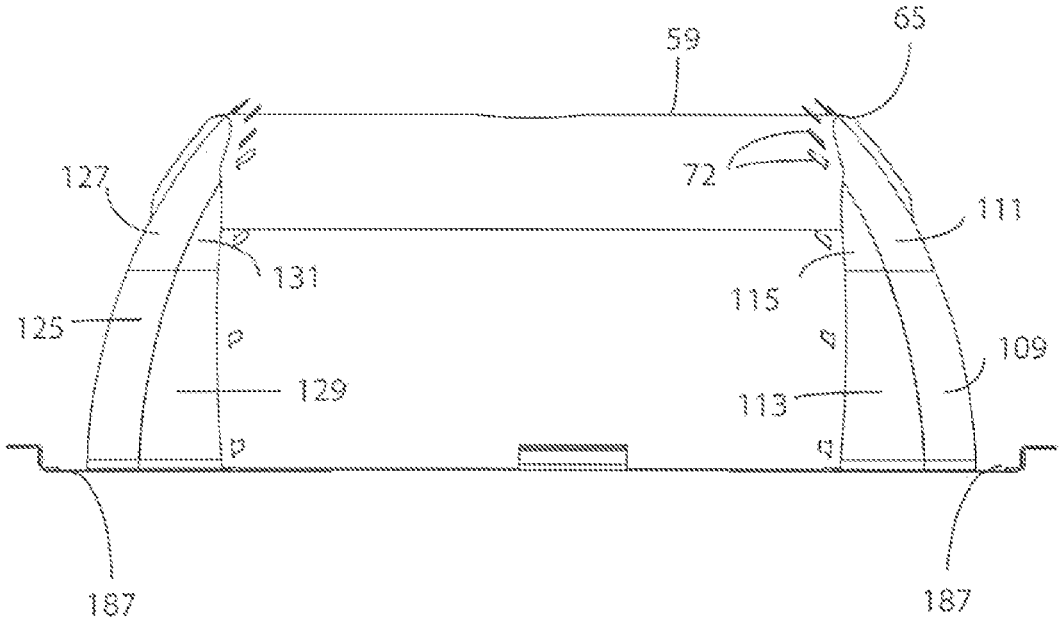
FIG. 11 is a rear side elevation view of the reflector of FIG. 9.
Figure 12:
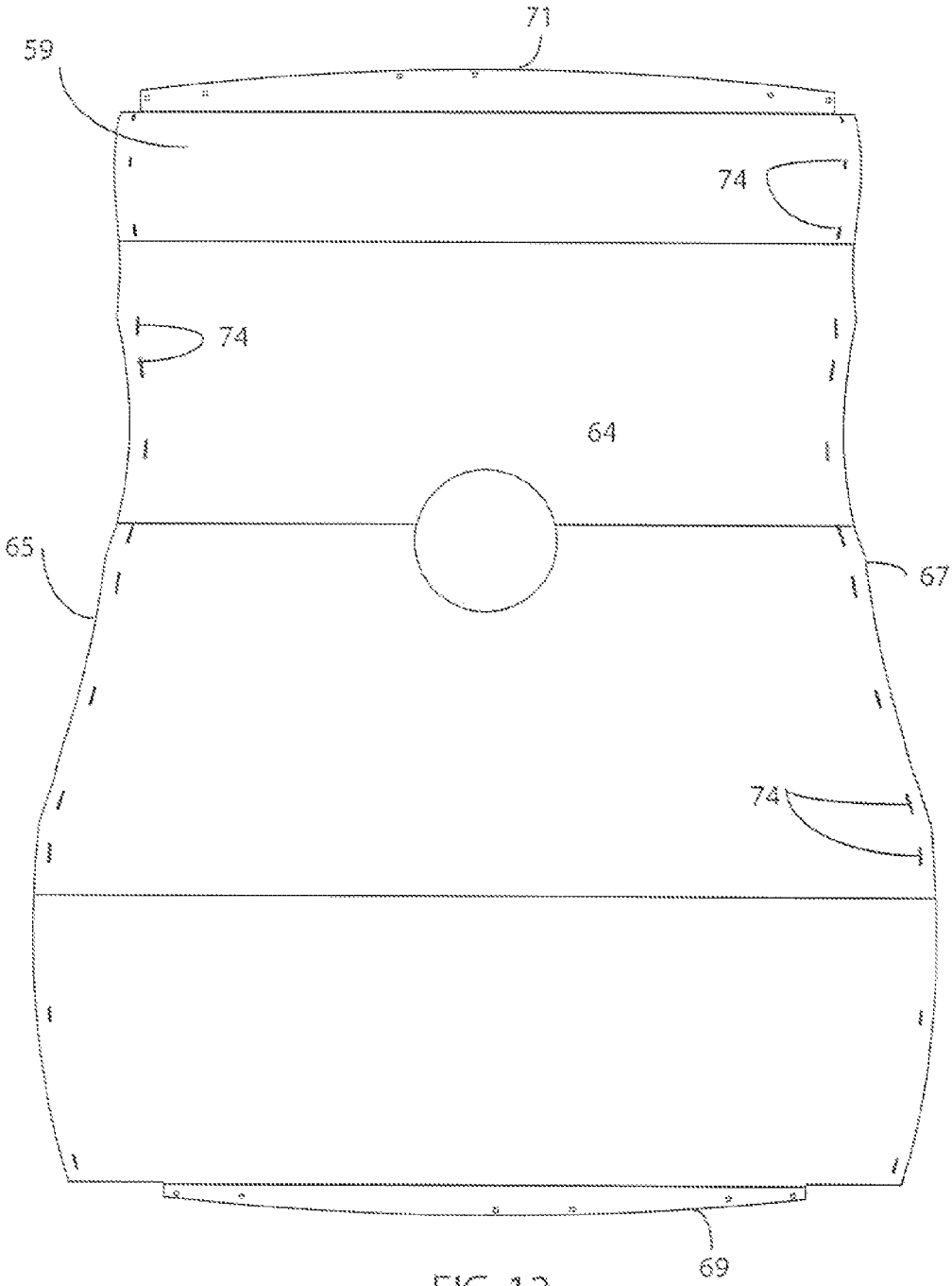
FIG. 12 is a plan view of the outer surface of a segmented center portion of the reflector of FIG. 9.
Figure 13:
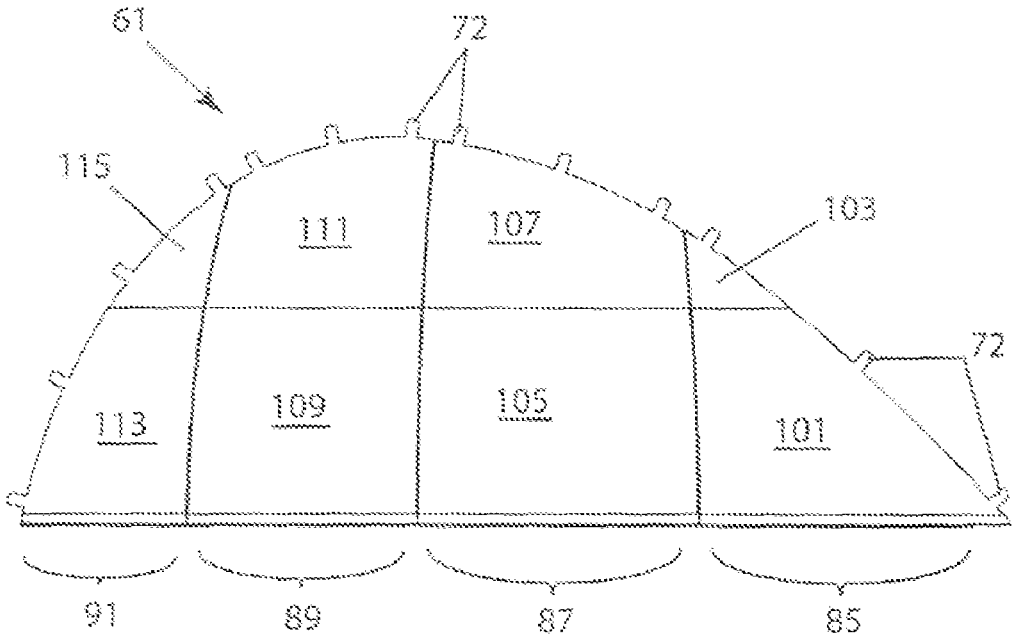
FIG. 13 is an elevation view of the outer surface of a segmented first side portion of the reflector of FIG. 9.
Figure 14:
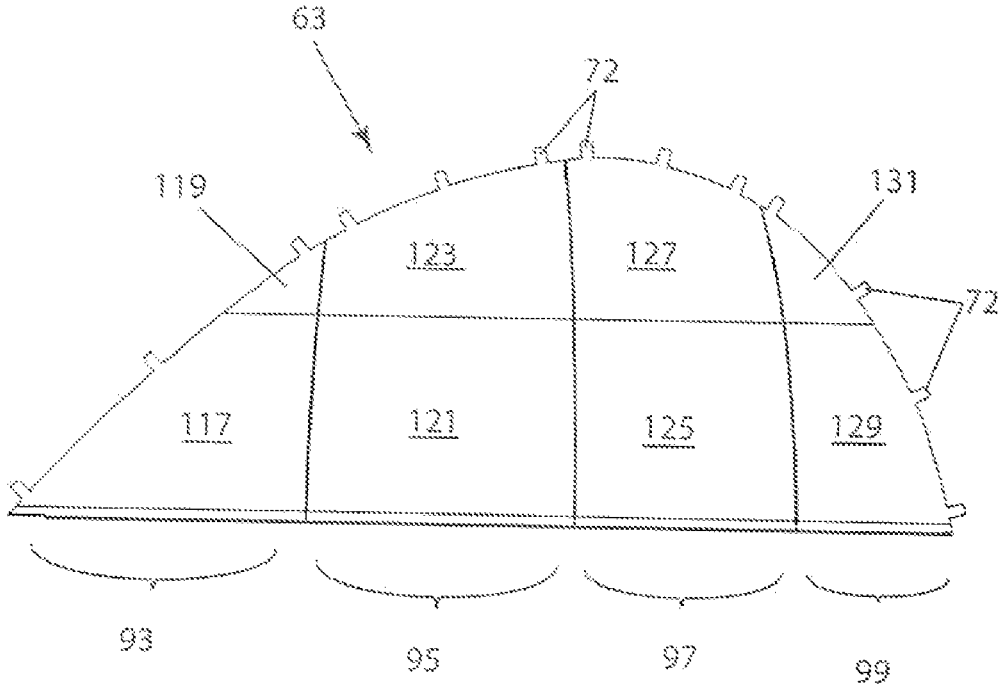
FIG. 14 is an elevation view of the outer surface of a segmented second side portion of the reflector of FIG. 9.

FIGS. 4-5 and 8 are illustrative of the targeted lighting effect provided by luminaire 10. FIG. 4, which is not to scale, is provided for the purpose of illustrating an exemplary target zone 13 and the reflector 11 segments 73-77, 101-133 which correspond generally to each subregion 133-169. Target zone 13 of the example consists of nineteen subregions along a surface area beneath luminaire 10 targeted for illumination by compound parabolic reflector 11. Center segmented portions 73, 75, 77 are targeted to direct a preponderance of light respectively onto center subregions 137, 135, and 133. Center segmented portions 73-77 provide the majority of illumination of target zone 13 produced by luminaire 10. Segmented side portion 61 segments 101-115 are targeted to direct a preponderance of light respectively onto target zone subregions 155-169 as indicated in FIG. 4. Segmented side portion 63 segments 117-131 are targeted to direct a preponderance of light respectively onto target zone subregions 141-153 as indicated in FIG. 4. Each subregion 133-169 indicates in the parenthetical the segment 73-77, 101-131 targeted at that subregion. While each segment 73-77, 101-131 directs a preponderance of light toward a different subregion 133-169, there is overlap of illumination by segments 73-77, 101-131 into more than one subregion, thereby producing a uniform lighting effect.

The isolux map computer-generated simulations of FIGS. 5 and 8 respectively represent the expected light output directed toward target zone 13 from luminaire 10 not including light shield 15 (FIGS. 1-3) and luminaire 10 including light shield 15 (FIGS. 6-7). The models used to produced the simulated isolux maps 171, 173 are based on use of a pole-mounted luminaire 10 mounted 22 feet above a flat surface 175 as shown in the inset to the right of each isolux map 171, 173. Each luminaire 10 in the simulation included a compound parabolic reflector 11 as illustrated in FIGS. 9-14 and a metal halide arc lamp having a luminous flux of 110,000 lumens. The minimum illumination of each zone is indicated on FIGS. 5 and 8 by the values associated with each zone in units of foot candles.

Referring to FIG. 5, isolux map 171 shows that luminaire 10, not including a light shield 15, casts concentrated bright light of 50 foot candles or greater in an approximate 240 square foot rectangle 177 to the front and sides of luminaire 10 and about 20 foot candles or greater in an approximate 560 square foot rectangle 179 to the front and sides of the luminaire 10. A typical IES recommendation for illumination of a surface area is 0.5 foot candles. The data indicate that the luminaire 10 provides a bright lighting effect. The lighting effect is uniformly high in the rectangular area of the target zone 13 to the front and sides of the luminaire 10.

Referring to FIG. 8, isolux map 173 illustrates that luminaire 10 including light shield 15 provides the bright and uniformly illuminated rectangular areas 181, 183 which are generally similar to areas 177, 179 of FIG. 5, but with relatively less light trespass in the area 185 behind each luminaire 10. The data indicate that light shield 15 is effective in blocking light emission behind luminaire 10. And, the data indicate that the shield 15 does not negatively effect the uniformly high illumination of the rectangular area in the target zone 13 to the front and sides of the luminaire 10.

Figure 15:
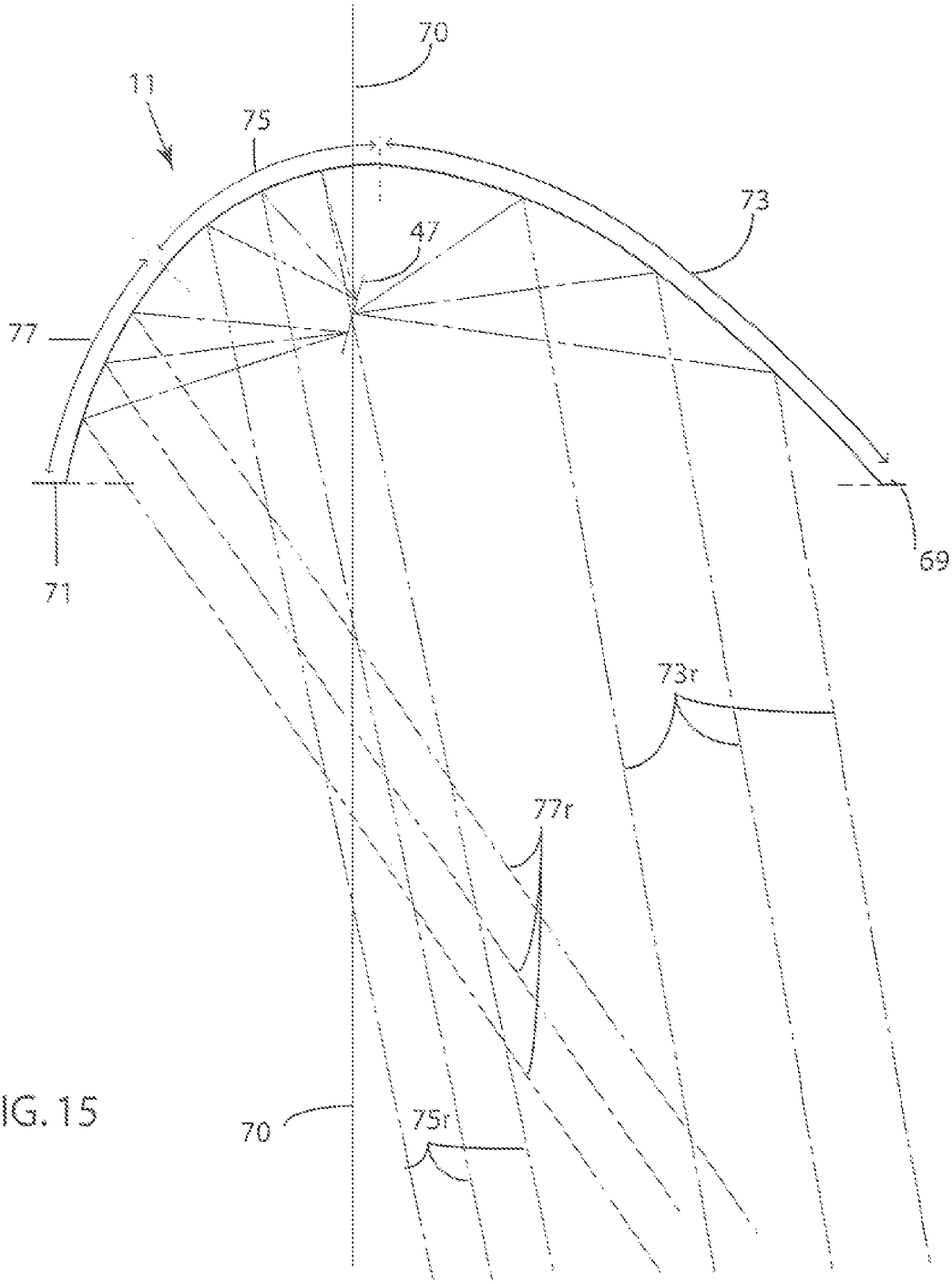
FIG. 15 is a two-dimensional ray trace from the segmented center reflector portion taken along section 15-15 of FIG. 10. Such sectional view includes a cross-section representation of the center reflector portion indicating its plural different parabolic portions.
Figure 16:
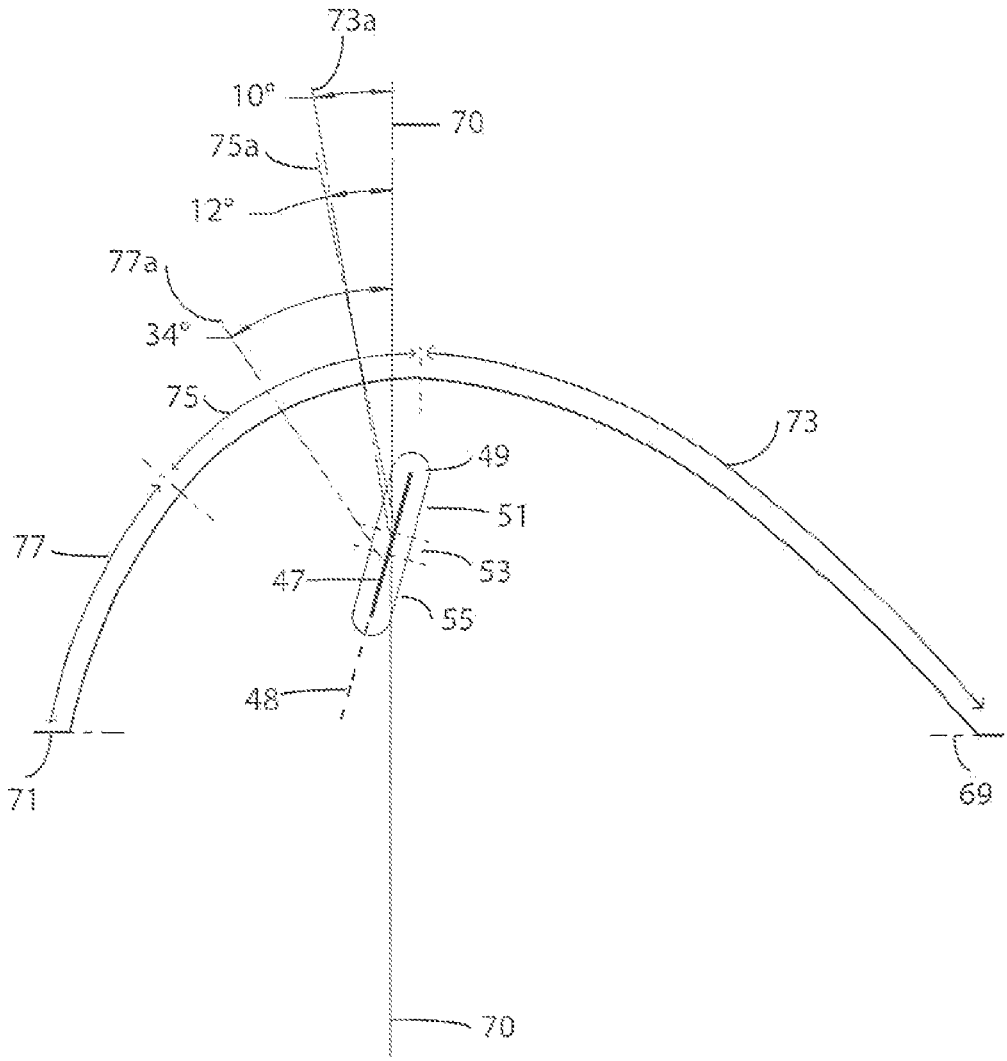
FIG. 16 is a cross-sectional view of an exemplary segmented center reflector portion taken along section 15-15 of FIG. 10 including a superimposed light-emitting segment location and parabola major axes and foci.
Figure 17:
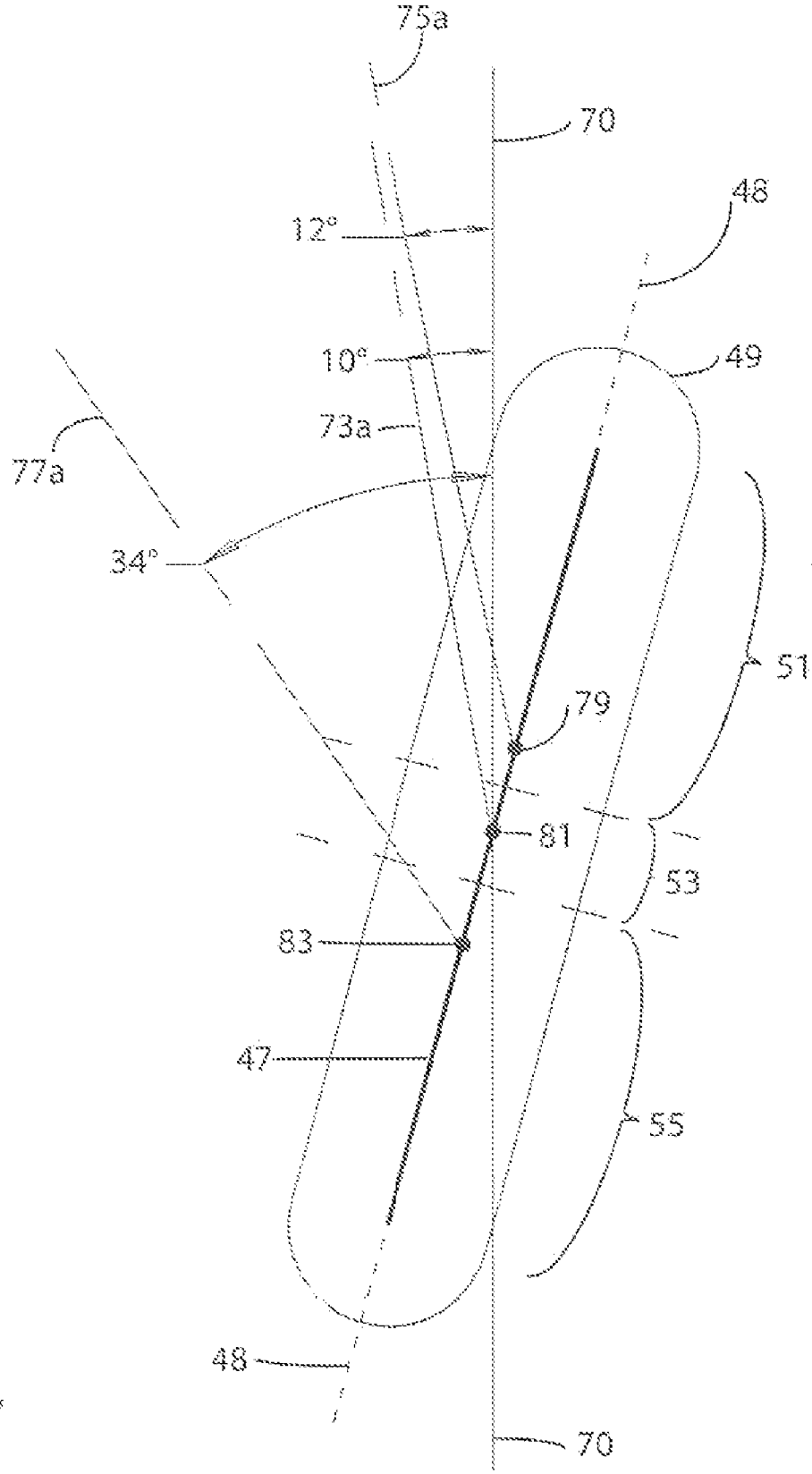
FIG. 17 is an enlarged view of the light-emitting segment location of FIG. 16 showing plural regions.

FIGS. 15-17 illustrate the aiming of segmented center portion 59 segments 73-77 and FIGS. 19-23 illustrate the aiming of segmented side portion 61, 63 segments 101-131 to achieve the results shown in FIGS. 4, 5 and 8. The improvement in luminaire 10 structure and operation arises in part from the recognition that the light energy emitted from light-emitting segment 47 of lamp 19 has a toroidal-shaped distribution extending outwardly from axis 48 of light-emitting segment 47 with relatively greater amounts of light emitted from the central region 53 of light-emitting segment 47 than from the upper and lower regions 51, 55. Based on this recognition, the partial parabolic segments, particularly the center segment portions 73, 75, 77, are positioned and arranged so that the foci 79, 81, 83 along the major axes of each partial parabola including the respective segment portions 73-77 are in a region of light-emitting segment 47 closest thereto, thereby optimizing reflection from each segment 73, 75, 77 to direct light to the target zone 13.

FIG. 15 is a two-dimensional ray trace for center portion 59 showing three representative light rays traced for each of the parabolas of segmented center portion 59 segments 73, 75, 77. Such rays are numbered 73*r*, 75*r*, and 77*r*, respectively, and illustrate the optical characteristics of a parabolic reflector 11, that is, the parabolic reflector reflects light rays from the focus of the parabola along directions parallel to the major axis of the parabola. FIG. 15 also illustrates the efficient design of reflector 11 because light rays are directed out of housing 17 with only a single contact with reflector 11, thereby minimizing light scattering effects.

Referring to FIGS. 16 and 17, the parabolas of segmented center portion 59 segments 73, 75, 77 have major axes 73*a*, 75*a*, and 77*a*, respectively, directing light generally along directions parallel to such major axes primarily from regions 53, 51, 55, respectively, of light-emitting segment 47. Referring to FIG. 4, light from segments 73, 75, 77 is generally directed toward target areas 137, 135, 133, respectively. It should be understood that since the light emitted from light-emitting segment 47 is emitted from entire regions rather than three precise individual focal points, the light reaching the various target areas is spread across the areas and to some degree into neighboring areas, producing the desirable effect of smoothing the distribution of lights across the various areas of target zone 13. Thus, referring to FIG. 17, regions 51, 53, 55 of light-emitting segment 47 contain the foci 79, 81, 83, respectively. It should be noted that simulated isolux maps 171 and 173 of FIGS. 5 and 8, respectively, take into account the fact that light is emitted from throughout the volume of light-emitting segment 47 rather than just from the various focal points of the partial parabolas of segmented reflector 11.

In exemplary luminaire 10, major axes 73*a*, 75*a*, and 77*a* are oriented at angles of 10°, 12°, and 34°, respectively, forward of nadir 70. Nadir 70 is a vertical axis which passes through the center of light-emitting segment 47. Axis 48 of light-emitting segment 47 is oriented at an angle of about −15° from nadir 70 as can be seen in FIGS. 16 and 17. Each axis 73*a*, 75*a*, 77*a* is forward of nadir 70 in that the direction of each axis 73*a*, 75*a*, 77*a* is toward the housing front side 30 and away from the housing rear side 32. Each major axis 75*a*, 77*a* is in front of another major axis to the extent that it is directed more toward the housing front side 30 than the other major axis. In the example, middle parabolic segment 75 major axis 75*a* is oriented forward of the front parabolic segment 73 major axis 73*a* and the rear parabolic segment 77 major axis 77*a* is oriented forward of the middle parabolic segment 75 major axis 75*a*.

Figure 19:
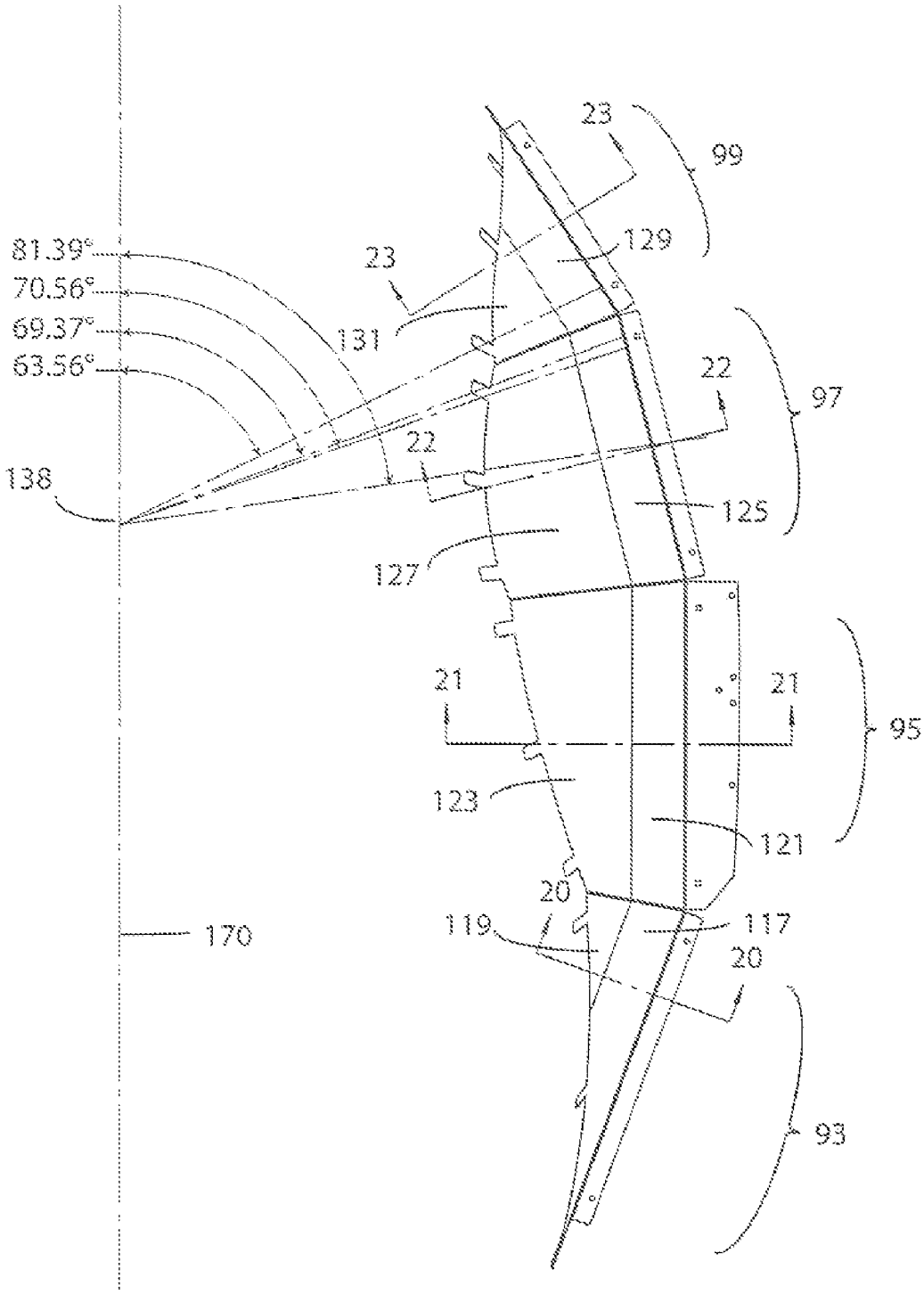
FIG. 19 is a top plan view of the outer surface of the segmented first side portion of the reflector of FIG. 13 including parabola major axes and foci in a horizontal plane.
Figure 20:
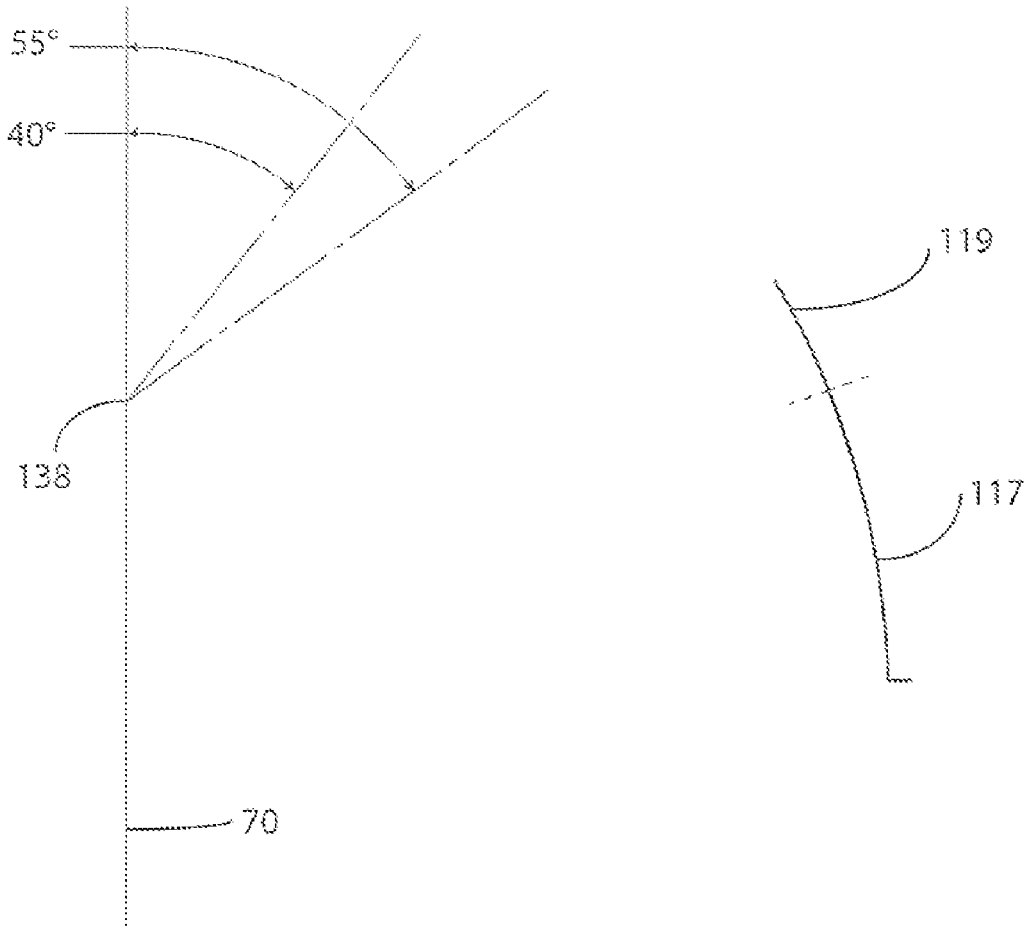
FIG. 20 is a cross-sectional view of a first side segment reflector section taken along section 20-20 of FIG. 19 including parabola major axes and foci in a vertical plane.
Figure 21:
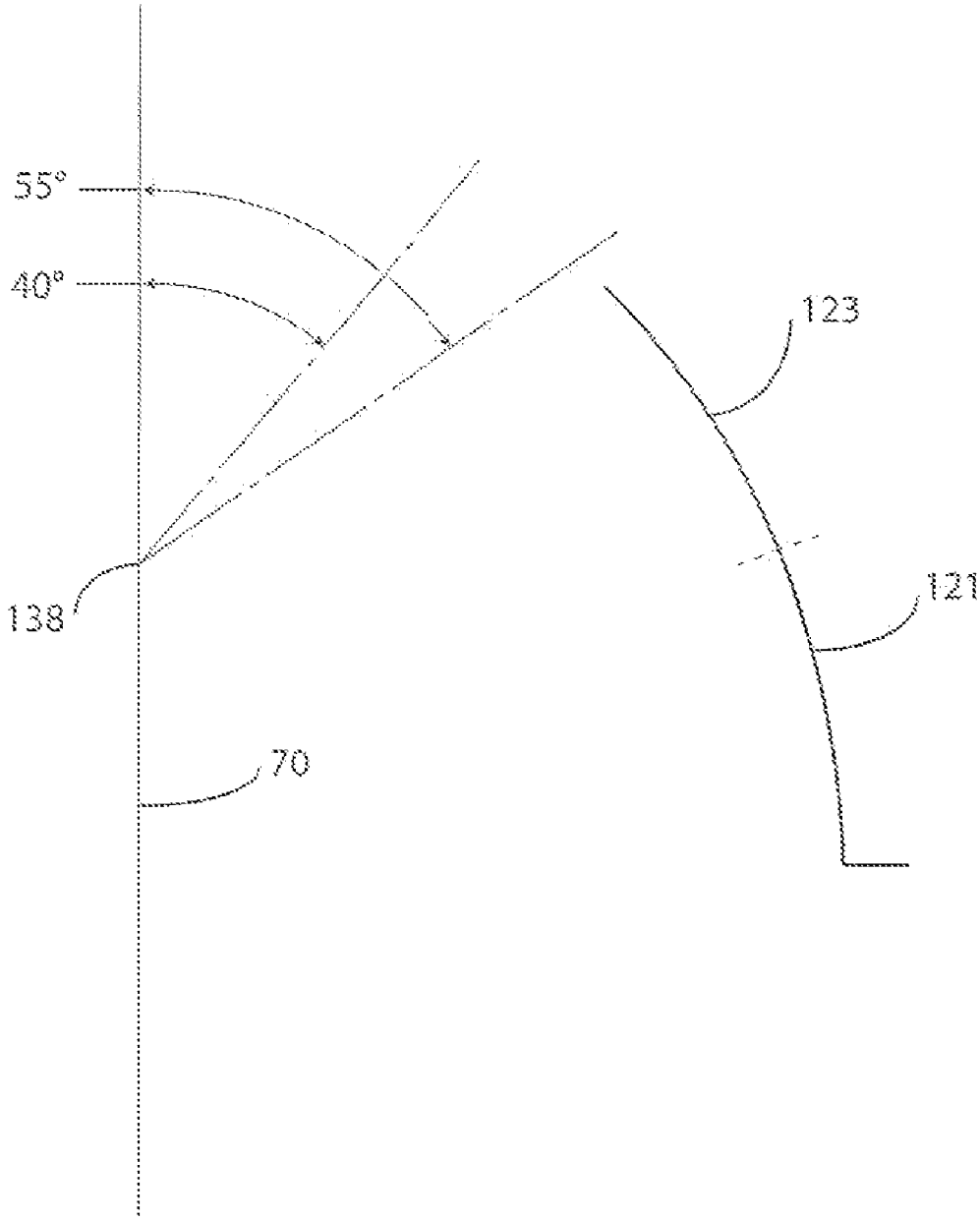
FIG. 21 is a cross-sectional view of a second side segment reflector section taken along section 21-21 of FIG. 19 including parabola major axes and foci in a vertical plane.
Figure 22:
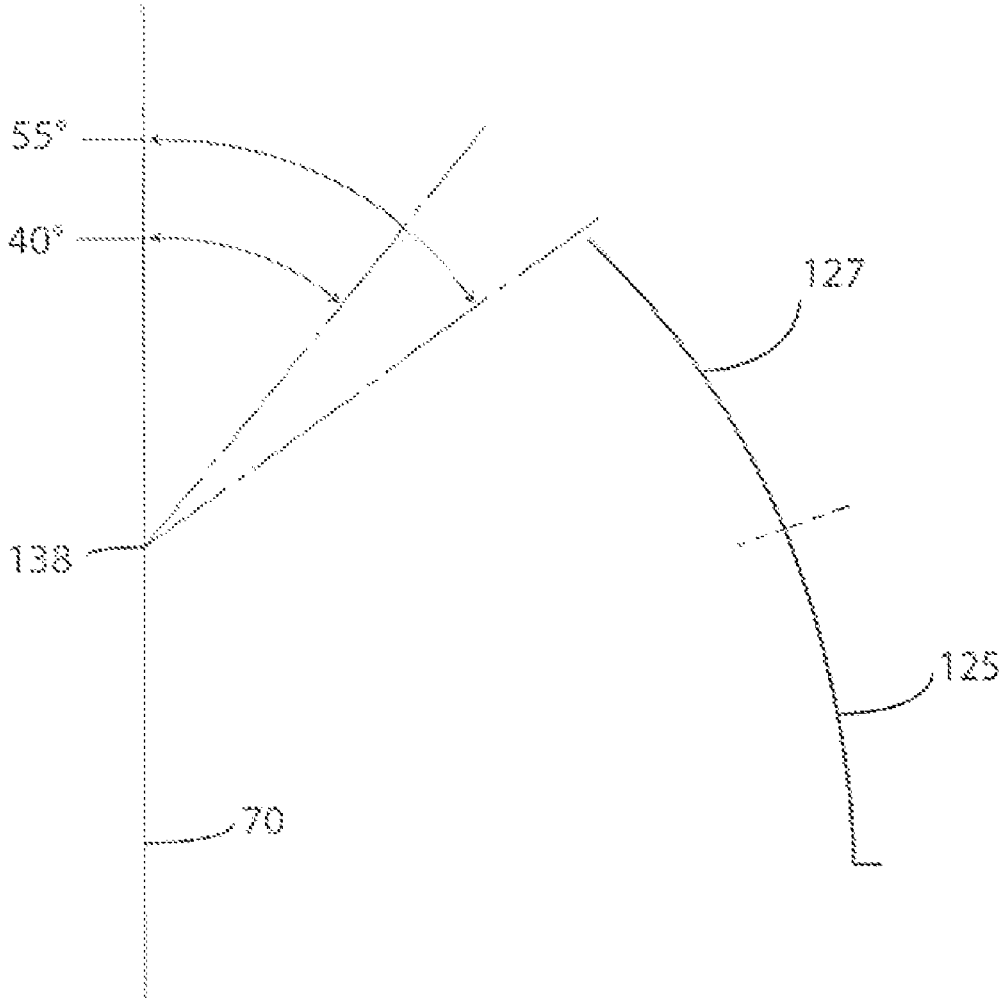
FIG. 22 is a cross-sectional view of a third segmented side reflector section taken along section 22-22 of FIG. 19 including parabola major axes and foci in a vertical plane.
Figure 23:
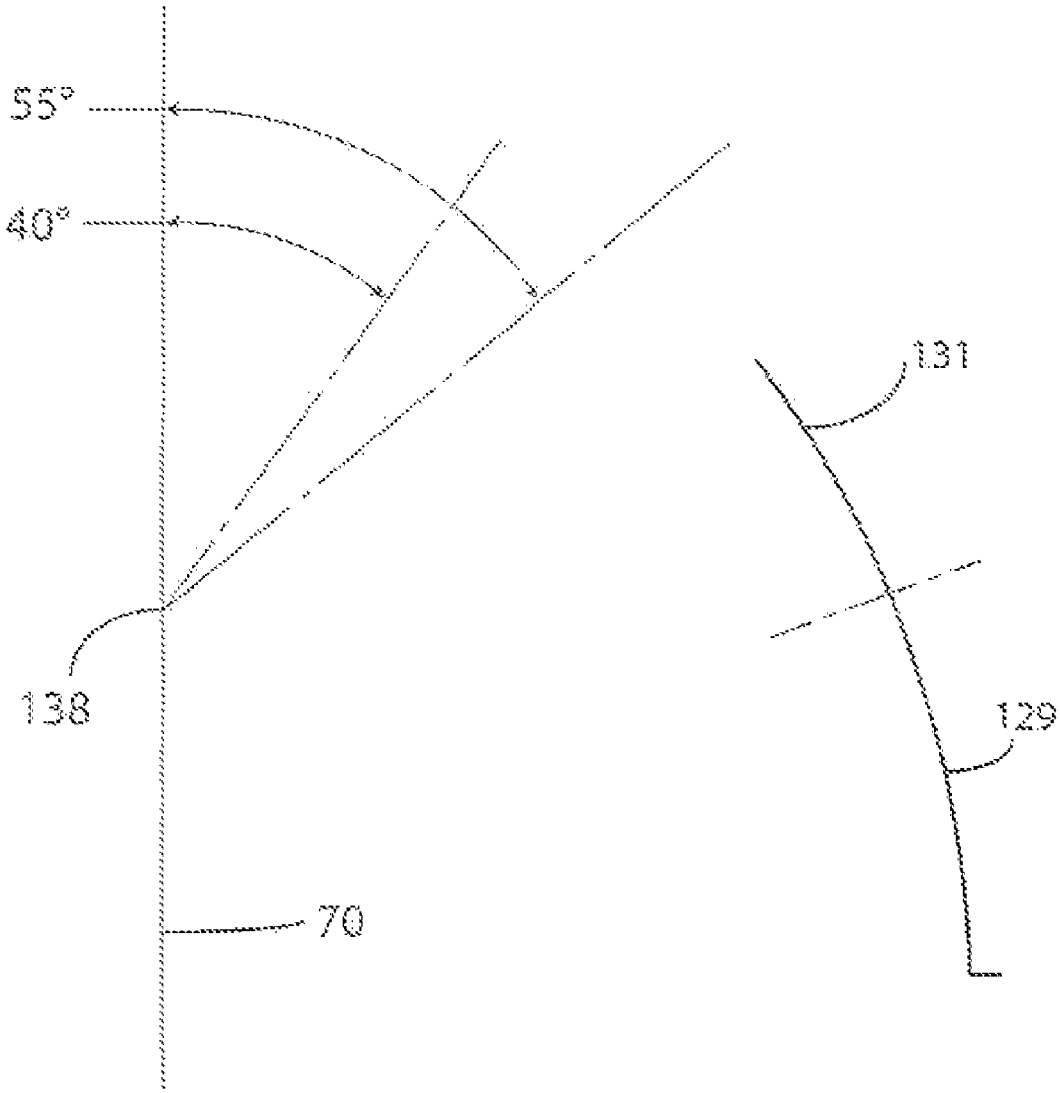
FIG. 23 is a cross-sectional view of a fourth segmented side reflector section taken along section 23-23 of FIG. 19 including parabola major axes and foci in a vertical plane.

FIG. 19 is a top plan view of the outer surface of segmented side portion 63 of reflector 11. In the embodiment, segmented side portions 63 and 61 are mirror images of the other. Therefore, the description of segmented side portion 63 is applicable to describe segmented side portion 61. As illustrated in FIG. 4, each parabolic segment 117-131 is shaped and oriented to direct light to a specific target area subregion 139-153 of target zone 13. To achieve such targeting, each segment 117-131 is a partial two-dimensional parabola to direct light laterally from reflector 11 at an angle from nadir 70 (a vertical axis) and is also oriented to direct such light laterally from a horizontal axis 170 so that the light is spread both generally forward and to the side across target area subregions 139-153 of target zone 13 as desired. Horizontal axis 170 is an axis parallel to horizontal housing opening 33 which passes through the center of light-emitting segment 47 and which symmetrically bisects reflector panel 11 as shown in FIG. 19.

Side portion 63 includes four sections 93-99, each of which includes a pair of segments, an upper parabolic segment and a lower parabolic segment. Side portion 63 includes: (1) front section 93 with upper segment 119 and lower segment 117; intermediate section 95 with upper segment 123 and lower segment 121; intermediate section 97 with upper segment 127 and lower segment 125; and rear section 99 with upper segment 131 and lower segment 129. Each of these eight segments has a major axis which passes through its common focal point 138.

FIG. 19 illustrates the orientation of the major axes of these eight segments 117-129 with respect to horizontal axis 170. In exemplary luminaire 10, the major axes of partial parabolas 117 and 119 of front section 93 are oriented at an angle of about 81°; the major axes of partial parabolas 121 and 123 of intermediate section 95 are oriented at an angle of about 69°; the major axes of partial parabolas 127 and 125 of intermediate section 97 are oriented at an angle of about 71°; and the major axes of partial parabolas 129 and 131 of rear section 99 are oriented at an angle of about 64°.

FIGS. 20-23 show four cross-sectional views of segmented side reflector portion 63 taken along the respective sections indicated in FIG. 19 in order to show the vertical orientation of the parabola major axes of the sections 93-99 of side portion 63. (As above, side portion 61 is configured to be the mirror image of side portion 63 and thus the description of side portion 63 applies to side portion 61.) The major axes of each upper segment 119, 123, 127, 131 is oriented with respect to nadir at an angle of 40° and each lower segment 117, 121, 125, 129 is oriented with respect to nadir 70 at an angle of 55°. The foci of each segment 117-131 are all located at common focal point 138 which is at the intersection of nadir 70 and horizontal axis 170.

Figure 18:
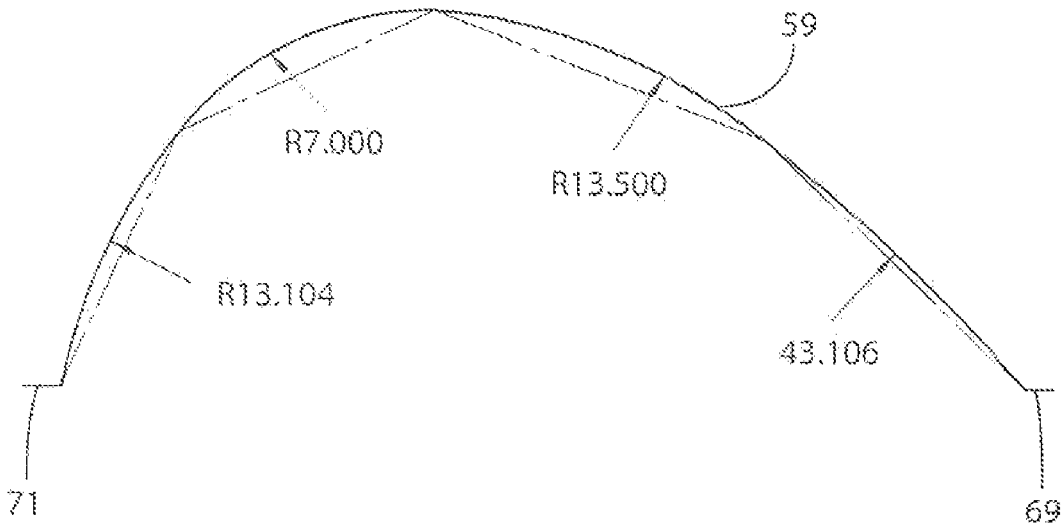
FIG. 18 is a schematic cross-sectional view of an exemplary segmented center reflector portion taken along section 15-15 of FIG. 10 showing representative circular fits for each segment.
Figure 24:
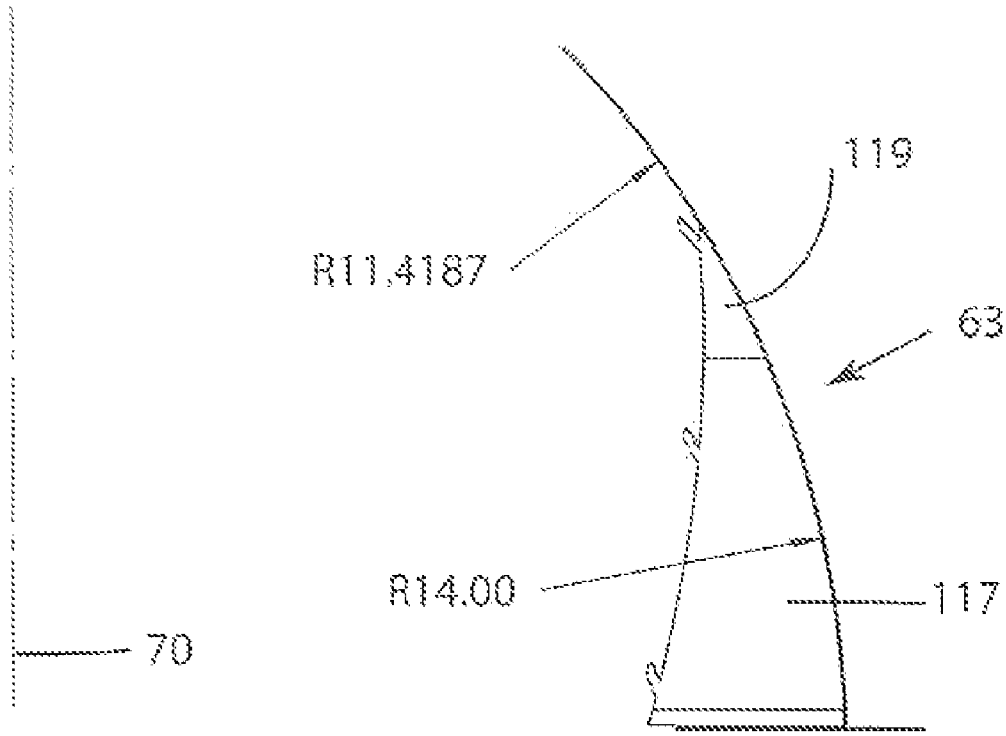
FIG. 24 is a schematic view of an exemplary segmented side reflector portion showing a representative circular fit in a generally vertical plane.

FIGS. 18 and 24 illustrate one approach to the fabrication of reflector 11. When the center 59 and side portions 61, 63 of reflector 11 are fabricated from pieces of sheet metal, it is convenient and cost-effective to approximate the partial parabolas as circular sections having radii of curvature. FIG. 18 shows one such embodiment for fabrication of reflector center portion 59. In the example, rear segment 77 partial parabola is approximated by a circular section having a radius of curvature of about 13 inches, center segment 75 partial parabola is approximated by a circular section having a radius of curvature of about 7 inches, and front segment 77 partial parabola is approximated by two circular sections respectively having radii of curvature of about 13.5 inches and about 43 inches.

FIG. 24 illustrates the same simplified fabrication approach, but with respect to side segment 63, and side segment 61 which is a mirror image of segment 63. Each of the four upper segments 119, 123, 127, 131 of side portion 63 (and of upper segments 103, 107, 111, 115 of side portion 61) approximates its partial parabolas with circular sections having radii of curvature of about 11 inches. Each of the four lower segments 117, 121, 125, 129 of side portion 63 (and of lower segments 101, 105, 109, 113 of side portion 61) approximates its partial parabolas with circular sections having radii of curvature of about 14 inches. In the example, each of the side section 85-99 sixteen segments 101-131 is fabricated with no curvature in the generally horizontal direction. FIG. 24 is a single drawing to illustrate the curvatures of each of these sixteen segments 101-131 of side portions 61, 63.

In the preferred embodiments shown, each of center 59 and side portions 61, 63 may be made of a separate piece of aluminum coil sheet stock with a metalized aluminum coating vapor-deposited along the inside of reflector 11 facing lamp 19. A representative premium reflective material suitable for use in manufacture of center 59 and side portions 61, 63 is sold under the trade name Miro 4 and is available from Alanod Aluminum—Veredlung GmbH & Co. The sheet stock material comprising each of center and side portions 59-63 may be stamped and rolled to form the circular approximations as described above. Center portion 59 ends 69, 71 may be riveted or tack welded to flange 187. Interconnection of tabs (e.g., tab 72) of side portions 61 with slots (e.g., slot 74), joins center and side portions 59, 61, 63 along edges 65, 67. After rolling, each side section 85-99 may be riveted or tack welded at its opposite end to flange 187 to provide a compound parabolic reflector 11 for mounting in housing 17 of luminaire 10.

It is envisioned that compound parabolic reflector 11 may have configurations consistent with the improvement, other than those of the preferred embodiment described herein. For example, while nineteen two-dimensional segments 73-77, 101-131 are shown, a greater or lesser number of segments may be used. Four side sections 95-99 on each side portion 61, 63 are preferred, but a greater or lesser number of side sections could be implemented. In still other embodiments, compound parabolic reflector 11 may be made of aluminum metalized molded plastic or hydro formed metal consistent with the improvement.

While the principles of this invention have been described in connection with specific embodiments, it should be understood clearly that these descriptions are made only by way of example and are not intended to limit the scope of the invention.

The invention claimed is:

1. A luminaire for illuminating a target zone having plural subregions in front of and to the sides of the luminaire, the luminaire comprising:

a housing having walls defining a bottom opening, such opening defining a plane;

a lamp holder in the housing positioned to support an electric lamp axially oriented generally perpendicular to the plane, such lamp having a light source substantially parallel to the axis of the electric lamp and having plural source-sectors; and a reflector in the housing partially surrounding the lamp and its light source, the reflector having:

a segmented center portion having first and second side edges each forming sides of the bottom opening and a first plurality of center segments each of which is parabolic in cross-section, the parabolic cross-sections of the segments having focal points in different ones of the plural light source-sectors such that each segment directs a preponderance of its reflected light toward a particular target zone subregion in front of the luminaire; and a pair of segmented side portions each forming sides of the bottom opening and each joined to the center portion along a respective one of the side edges, each side portion having a second plurality of side segments each of which is parabolic in cross-section, the parabolic cross-sections of the segments having focal points along the light source-sectors such that each segment directs a preponderance of its reflected light toward a particular target zone subregion to a respective side of the luminaire.

2. The luminaire of claim 1 wherein the plural source-sectors include upper, middle, and lower regions.

3. The luminaire of claim 2 wherein the source-sectors are along an axis oriented between about ±15° from vertical.

4. The luminaire of claim 3 wherein the segmented center portion has front, middle, and rear parabolic segments.

5. The luminaire of claim 4 wherein the front parabolic segment has its focal point in the middle source-sector, the middle parabolic segment has its focal point in the upper source-sector, and the rear parabolic segment has its focal point in the lower source-sector.

6. The luminaire of claim 5 wherein the luminaire has a nadir along a vertical axis bisecting the source-sector. and each of the front, middle and rear parabolic segments has a major axis forward of nadir and, wherein, the middle parabolic segment major axis is oriented forward of the front parabolic segment major axis and the rear parabolic segment major axis is oriented forward of the middle parabolic segment major axis.

7. The luminaire of claim 6 wherein:

the front parabolic segment major axis is oriented at about 10° forward of the nadir;

the middle parabolic segment major axis is oriented at about 12° forward of the nadir; and the rear parabolic segment major axis is oriented at about 34° forward of the nadir.

8. The luminaire of claim 6 wherein each of the segmented side portions has front, intermediate, and rear sections.

9. The luminaire of claim 8 wherein each side segmented portion is three-dimensional.

10. The luminaire of claim 9 wherein each of the front, intermediate and rear sections has an upper and a lower two-dimensional parabolic segment.

11. The luminaire of claim 10 wherein each parabolic segment has a major axis oriented laterally outward from the nadir and laterally outward from a horizontal axis symmetrically bisecting the reflector panel, and, wherein:

each lower segment major axis is oriented laterally outward from nadir at a greater angle than each upper segment major axis;

each intermediate segment major axis is oriented laterally outward from the horizontal axis at a greater angle than each rear segment major axis; and each front segment major axis is oriented laterally outward from the horizontal axis at a greater angle than each intermediate segment major axis.

12. The luminaire of claim 11 wherein each segmented side portion has a pair of intermediate sections.

13. The luminaire of claim 10 wherein:

each lower segment major axis is oriented laterally outward from nadir at about 55° and each upper segment major axis is oriented laterally outward from nadir at about 40°;

each front segment major axis is oriented laterally outward from the horizontal axis at an angle of about 81°;

each intermediate segment major axis is oriented laterally outward from the horizontal axis at an angle of between about 71° and 69°; and each rear segment major axis is oriented laterally outward from the horizontal axis at an angle of about 64°.

14. The luminaire of claim 10 wherein each side portion parabolic segment comprises one or more circular segments to approximate the parabolic segment shape.

15. The luminaire of claim 1 wherein the housing bottom opening lies in a plane and the lamp mount is positioned in the housing so that a lamp mounted therein is fully above the plane.

16. The luminaire of claim 1 wherein the housing further includes:

a rear side; and a shield extending downwardly from the rear side below a plane of the horizontal opening to limit light spillage rearward of the luminaire.

17. The luminaire of claim 1 wherein each center portion parabolic segment comprises one or more circular segments to approximate the parabolic segment shape.

18. The luminaire of claim 1 wherein the segmented center and second side portions are each made of a separate piece of material.

19. The luminaire of claim 1 wherein each piece of material has an inner side facing the lamp mount and the inner side includes a metalized coating thereon.

* * * * *